US011040537B2

(12) United States Patent
Horiguchi

(10) Patent No.: US 11,040,537 B2
(45) Date of Patent: Jun. 22, 2021

(54) HEAD CHIP, LIQUID JET HEAD AND LIQUID JET RECORDING DEVICE

(71) Applicant: SII Printek Inc., Chiba (JP)

(72) Inventor: Satoshi Horiguchi, Chiba (JP)

(73) Assignee: STI PRINTEK INC., Chiba (JP)

( * ) Notice: Subject to any disclaimer, the term of this patent is extended or adjusted under 35 U.S.C. 154(b) by 0 days.

(21) Appl. No.: 16/675,926

(22) Filed: Nov. 6, 2019

(65) Prior Publication Data

US 2020/0147968 A1 May 14, 2020

(30) Foreign Application Priority Data

Nov. 9, 2018 (JP) ..... JP2018-211471

(51) Int. Cl.
*B41J 2/14* (2006.01)
*B41J 2/16* (2006.01)

(52) U.S. Cl.
CPC ..... *B41J 2/1621* (2013.01); *B41J 2/14209* (2013.01); *B41J 2/14233* (2013.01); *B41J 2002/14491* (2013.01)

(58) Field of Classification Search
CPC ..... B41J 2/14209; B41J 2002/14491
See application file for complete search history.

(56) References Cited

U.S. PATENT DOCUMENTS 5,984,447 A * 11/1999 Ohashi ..... B41J 2/14209 310/345
2017/0087840 A1* 3/2017 Nishikawa ..... B41J 2/14201

FOREIGN PATENT DOCUMENTS

JP 2014-233875 A 12/2014

* cited by examiner

*Primary Examiner* — Sharon Polk
(74) *Attorney, Agent, or Firm* — Brinks Gilson & Lione

(57) ABSTRACT

A head chip, liquid jet head, and liquid jet recording device are described. An actuator plate is adapted to apply pressure to the liquid, and includes a first surface, and a second surface facing to an opposite side to the first surface, ejection channels and non-ejection channels which have an opening on the first and/or second surface and are alternately arranged to be separated from each other, a common electrode disposed on a sidewall of the ejection channel, an individual electrode electrically separated from the common electrode and disposed on a sidewall of the non-ejection channel, a common electrode pad disposed on the first surface and adapted to electrically connect the common electrode and a wiring board to each other, and a bypass interconnection adapted to electrically connect the individual electrodes in the non-ejection channels adjacent to each other and failing to be exposed on the first surface.

8 Claims, 22 Drawing Sheets

HEAD CHIP, LIQUID JET HEAD AND LIQUID JET RECORDING DEVICE

RELATED APPLICATIONS

This application claims priority to Japanese Patent Application Nos. 2018-211471 filed on Nov. 9, 2018, the entire content of which is incorporated herein by reference.

BACKGROUND OF THE INVENTION

1. Field of the Invention

The present disclosure relates to a head chip, a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., JP-A-2014-233875).

In the liquid jet recording device of this type, it is arranged so that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

In such a head chip or the like, it is desired to prevent, for example, occurrence of short circuit between electrodes different in potential to enhance the reliability. Therefore, it is desirable to provide a head chip, a liquid jet head, and a liquid jet recording device capable of enhancing the reliability.

SUMMARY OF THE INVENTION

A head chip according to an embodiment of the present disclosure is a head chip adapted to jet liquid including an actuator plate adapted to apply pressure to the liquid, wherein the actuator plate includes a first surface, and a second surface facing to an opposite side to the first surface, ejection channels and non-ejection channels which have an opening on at least one of the first surface and the second surface and are alternately arranged so as to be separated from each other, a common electrode disposed on a sidewall of the ejection channel, an individual electrode electrically separated from the common electrode and disposed on a sidewall of the non-ejection channel, a common electrode pad disposed on the first surface and adapted to electrically connect the common electrode and an external interconnection to each other, and a bypass interconnection adapted to electrically connect the individual electrodes in the non-ejection channels adjacent to each other to each other and failing to be exposed on the first surface.

A liquid jet head according to an embodiment of the present disclosure is a liquid jet head adapted to jet liquid including an actuator plate adapted to apply pressure to the liquid, and a wiring board, wherein the actuator plate includes a first surface, and a second surface facing to an opposite side to the first surface, ejection channels and non-ejection channels which have an opening on at least one of the first surface and the second surface and are alternately arranged so as to be separated from each other, a common electrode disposed on a sidewall of the ejection channel, an individual electrode electrically separated from the common electrode, and disposed on a sidewall of the non-ejection channel, a common electrode pad disposed on the first surface and adapted to electrically connect the common electrode and the wiring board to each other, and a bypass interconnection adapted to electrically connect the individual electrodes in the non-ejection channels adjacent to each other and failing to be exposed on the first surface.

A liquid jet recording device according to an embodiment of the disclosure is provided with the liquid jet head according to an embodiment of the disclosure, and a containing section adapted to contain the liquid.

According to the head chip, the liquid jet head and the liquid jet recording device related to an embodiment of the disclosure, it becomes possible to enhance the reliability.

DETAILED DESCRIPTION OF THE PREFERRED EMBODIMENTS

An embodiment of the present disclosure will hereinafter be described in detail with reference to the drawings. It should be noted that the description will be presented in the following order:

1. Embodiment (an example of an edge-shoot type inkjet head in which a flow channel plate is disposed between a pair of head chips, and which performs ink circulation)
2. Modified Examples:
   - Modified Example 1 (an example of an edge-shoot type inkjet head in which a flow channel plate is disposed between a pair of head chips, and which does not perform ink circulation)
   - Modified Example 2 (an example of an edge-shoot type inkjet head in which a head chip is disposed on one side of a flow channel plate, and which performs ink circulation)
   - Modified Example 3 (an example of an edge-shoot type inkjet head supplied with ink from outside of a pair of head chips)
3. Other Modified Examples

1. EMBODIMENT

[Overall Configuration of Printer 1]

Figure 1:
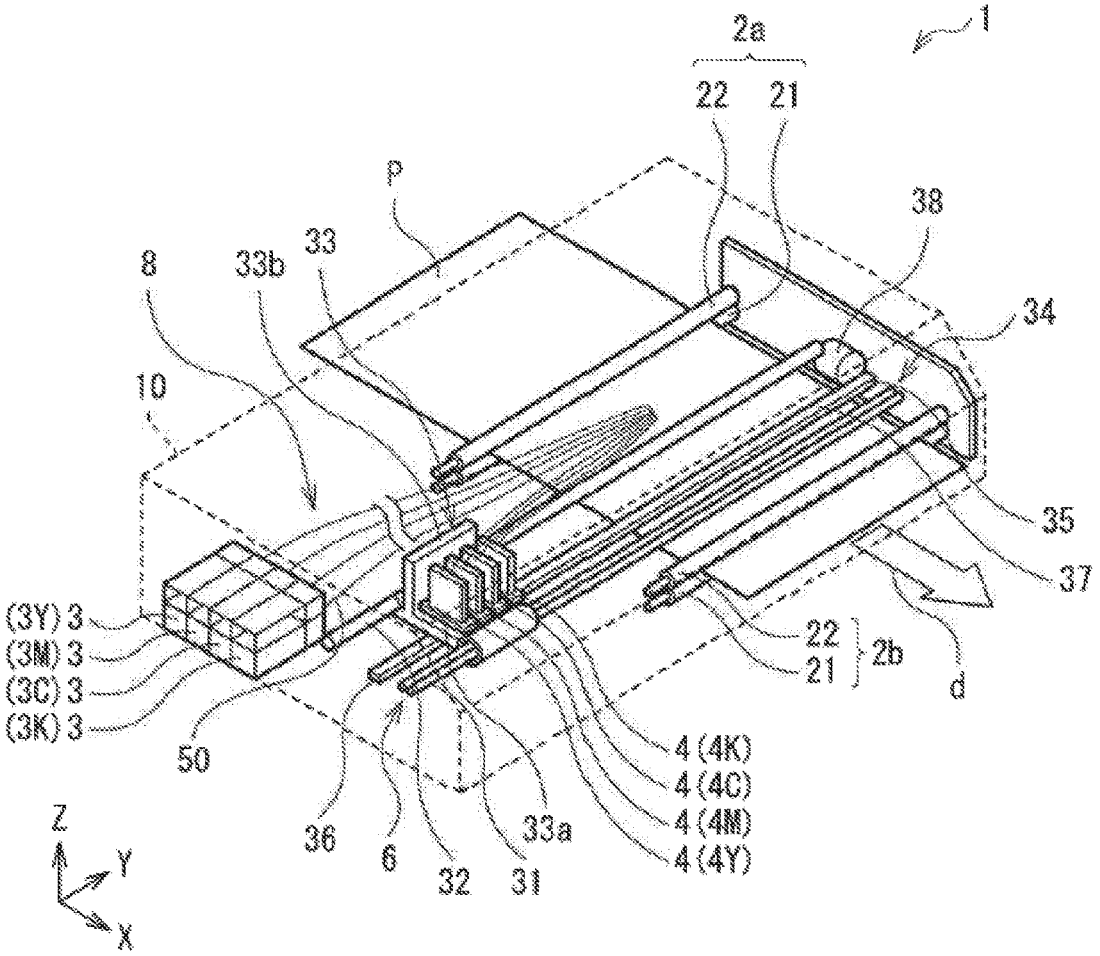
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink.

As shown in FIG. 1, the printer 1 is provided with a pair of carrying mechanisms 2*a*, 2*b*, ink tanks 3, inkjet heads 4, supply tubes 50, a scanning mechanism 6, and an ink circulation mechanism 8. These members are housed in a housing 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4K described later) each correspond to a specific example of the "liquid jet head" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink inside. As the ink tanks 3, there are disposed four types of tanks for individually containing the ink of four colors of yellow (Y), magenta (M), cyan (C), and black (K) in this example as shown in FIG. 1. In other words, there are disposed the ink tank 3Y for containing the yellow ink, the ink tank 3M for containing the magenta ink, the ink tank 3C for containing the cyan ink, and the ink tank 3K for containing the black ink. These ink tanks 3Y, 3M, 3C, and 3K are arranged side by side along the X-axis direction inside the housing 10.

It should be noted that the ink tanks 3Y, 3M, 3C, and 3K have the same configuration except the color of the ink contained, and are therefore collectively referred to as ink tanks 3 in the following description. Here, the ink tanks 3 each correspond to a specific example of a "containing section" in the present disclosure.

(Inkjet Heads 4)

The inkjet heads 4 are each a head for jetting (ejecting) the ink having a droplet shape from a plurality of nozzles 78 described later to the recording paper P to thereby perform recording of images, characters, and so on. As the inkjet heads 4, there are also disposed four types of heads for individually jetting the four colors of ink respectively contained in the ink tanks 3Y, 3M, 3C, and 3K described above in this example as shown in FIG. 1. In other words, there are disposed the inkjet head 4Y for jetting the yellow ink, the inkjet head 4M for jetting the magenta ink, the inkjet head 4C for jetting the cyan ink, and the inkjet head 4K for jetting the black ink. These inkjet heads 4Y, 4M, 4C and 4K are arranged side by side along the Y-axis direction inside the housing 10.

It should be noted that the inkjet heads 4Y, 4M, 4C, and 4K have the same configuration except the color of the ink used, and are therefore collectively referred to as inkjet heads 4 in the following description. Further, the detailed configuration of the inkjet heads 4 will be described later (see FIG. 2 and so on).

The supply tubes 50 are each a tube for supplying the ink from the inside of the ink tank 3 to the inside of the inkjet head 4.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 31, 32 disposed so as to extend along the Y-axis direction, a carriage 33 movably supported by these guide rails 31, 32, and a drive mechanism 34 for moving the carriage 33 along the Y-axis direction. Further, the drive mechanism 34 has a pair of pulleys 35, 36 disposed between the guide rails 31, 32, an endless belt 37 wound between the pair of pulleys 35, 36, and a drive motor 38 for rotationally driving the pulley 35.

The pulleys 35, 36 are respectively disposed in areas corresponding to the vicinities of both ends in each of the guide rails 31, 32 along the Y-axis direction. To the endless belt 37, there is coupled the carriage 33. The carriage 33 has a base 33*a* having a plate-like shape for mounting the four types of inkjet heads 4Y, 4M, 4C, and 4K described above, and a wall section 33*b* erected vertically (in the Z-axis direction) from the base 33*a*. On the base 33*a*, the inkjet heads 4Y, 4M, 4C, and 4K are arranged side by side along the Y-axis direction.

It should be noted that it is arranged that there is constituted a moving mechanism for moving the inkjet heads 4 and the recording paper P relatively to each other by such a scanning mechanism 6 and the carrying mechanisms 2*a*, 2*b* described above.

(Ink Circulation Mechanism 8)

Figure 2:
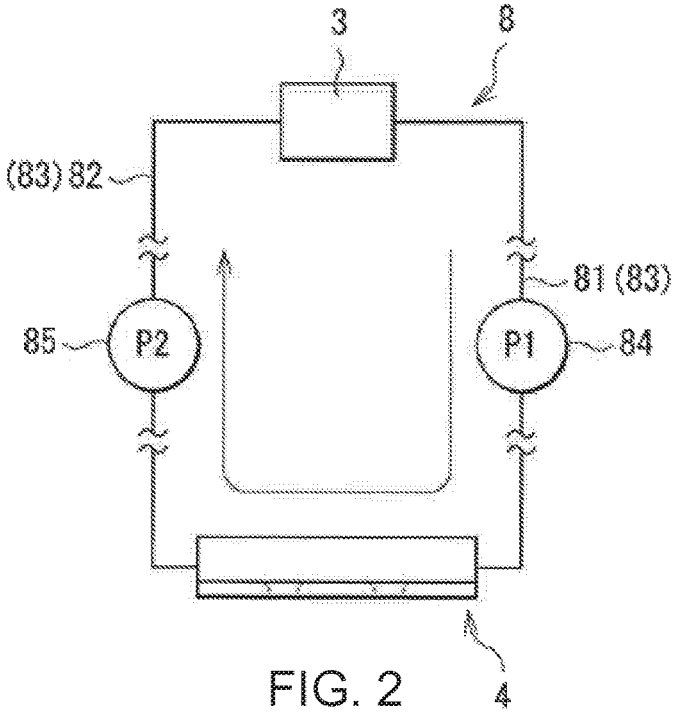
FIG. 2 is a schematic diagram showing a schematic configuration example of a liquid jet head and an ink circulation mechanism shown in FIG. 1.

FIG. 2 is a schematic diagram showing a schematic configuration example of the ink circulation mechanism 8. The ink circulation mechanism 8 is a mechanism for circulating the ink between the ink tank 3 and the inkjet head 4, and is provided with a circulation flow channel 83 constituted by an ink supply tube 81 and an ink discharge tube 82, a pressure pump 84 provided to the ink supply tube 81, and a suction pump 85 provided to the ink discharge tube 82. The ink supply tube 81 and the ink discharge tube 82 are each formed of, for example, a flexible hose having flexibility to the extent of being capable of following the action of the scanning mechanism 6 for supporting the inkjet heads 4.

The pressure pump 84 is for pressurizing the inside of the ink supply tube 81 to deliver the ink to the inkjet head 4 through the ink supply tube 81. Due to the function of the pressure pump 84, the inside of the ink supply tube 81 between the pressure pump 84 and the inkjet head 4 is provided with positive pressure with respect to the inkjet head 4.

The suction pump 85 is for depressurizing the inside of the ink discharge tube 82 to suction the ink from the inkjet head 4 through the ink discharge tube 82. Due to the function of the suction pump 85, the inside of the ink discharge tube 82 between the suction pump 85 and the inkjet head 4 is provided with negative pressure with respect to the inkjet head 4. It is arranged that the ink can circulate between the inkjet head 4 and the ink tank 3 through the circulation flow channel 83 by driving the pressure pump 84 and the suction pump 85. It should be noted that the ink circulation mechanism 8 is not limited to the configuration described above, but can also be provided with other configurations.

[Detailed Configuration of Inkjet Head 4]

Figure 3:
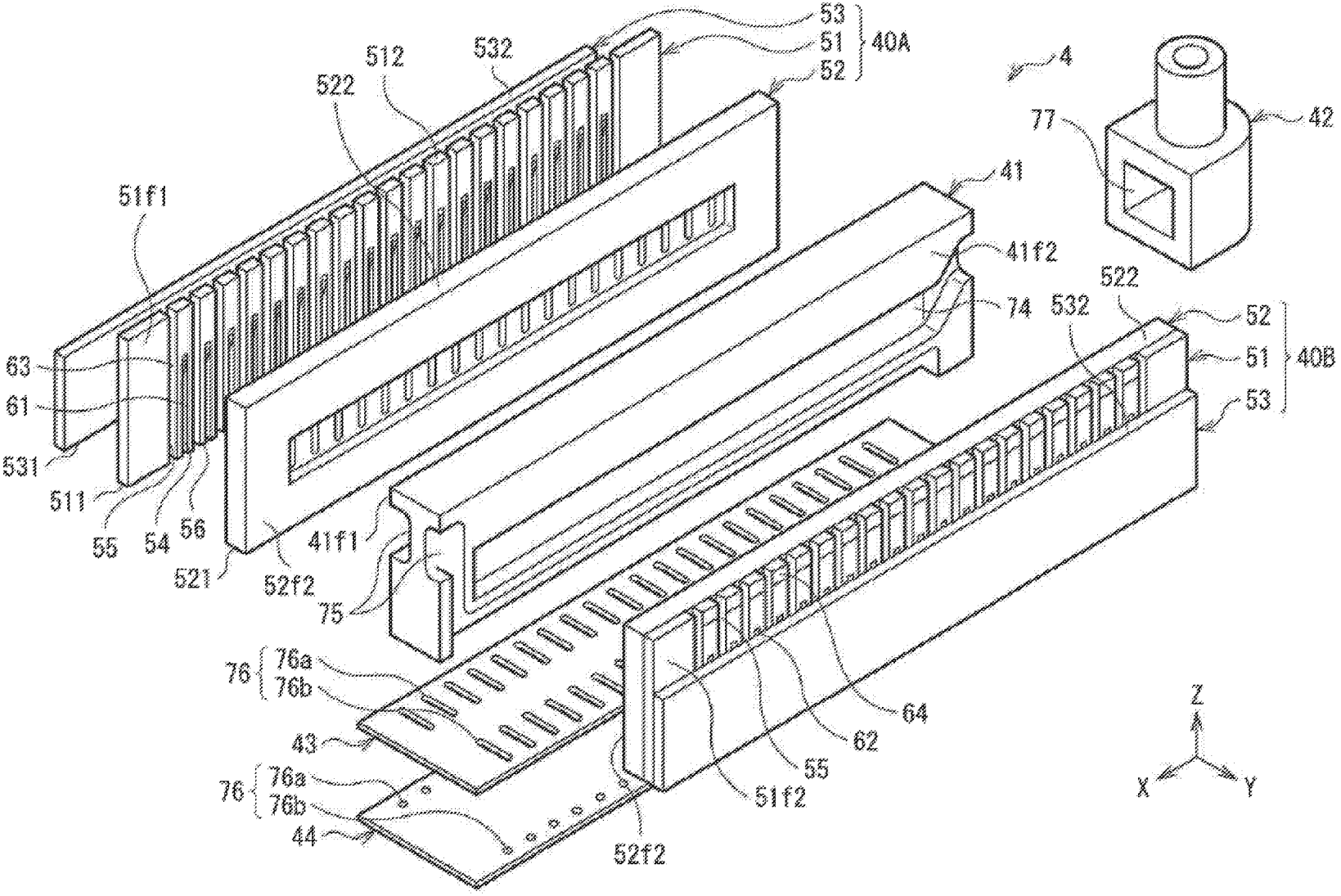
FIG. 3 is an exploded perspective view of the liquid jet head shown in FIG. 1.
Figure 4:
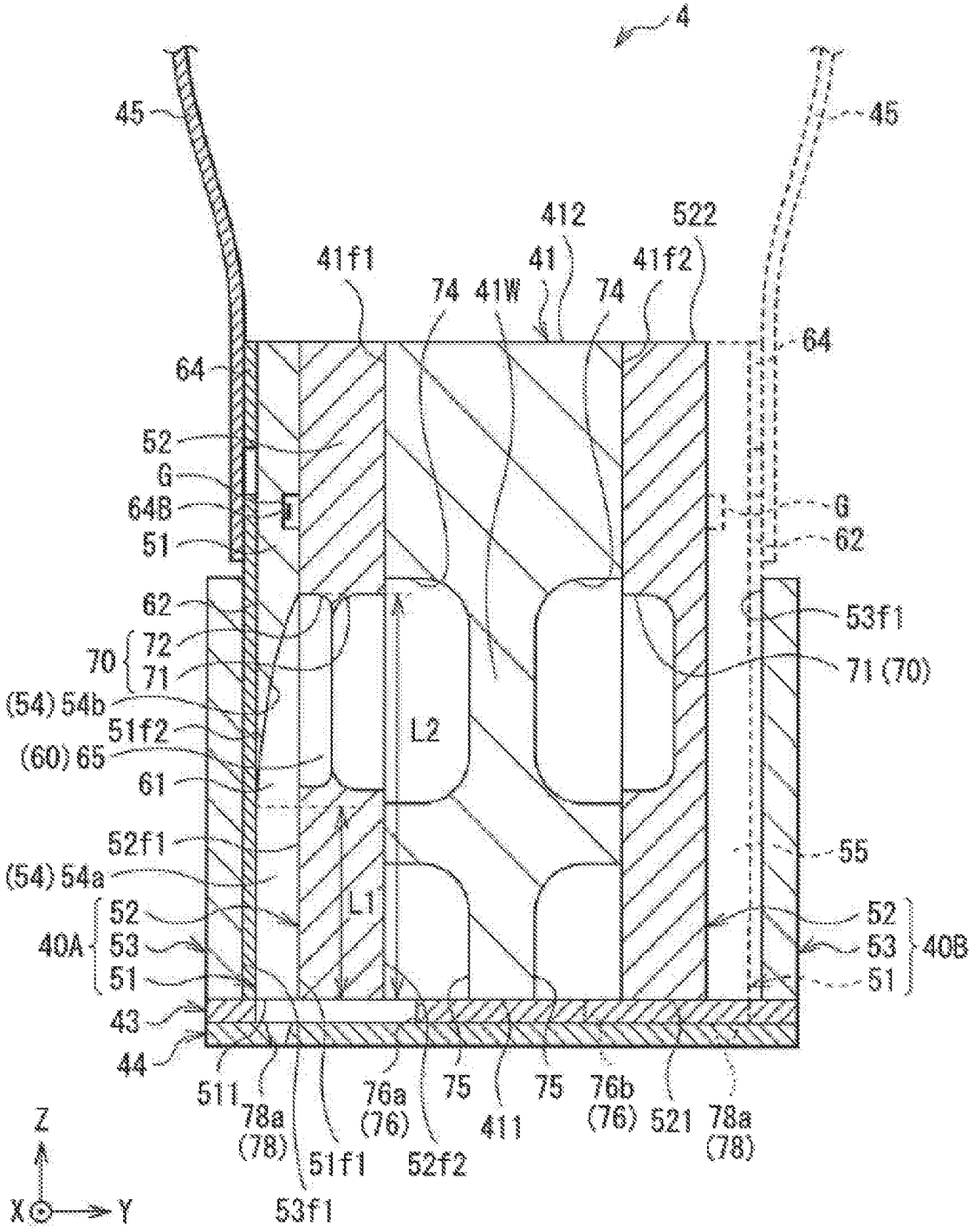
FIG. 4 is a cross-sectional view of the liquid jet head shown in FIG. 1.
Figure 5:
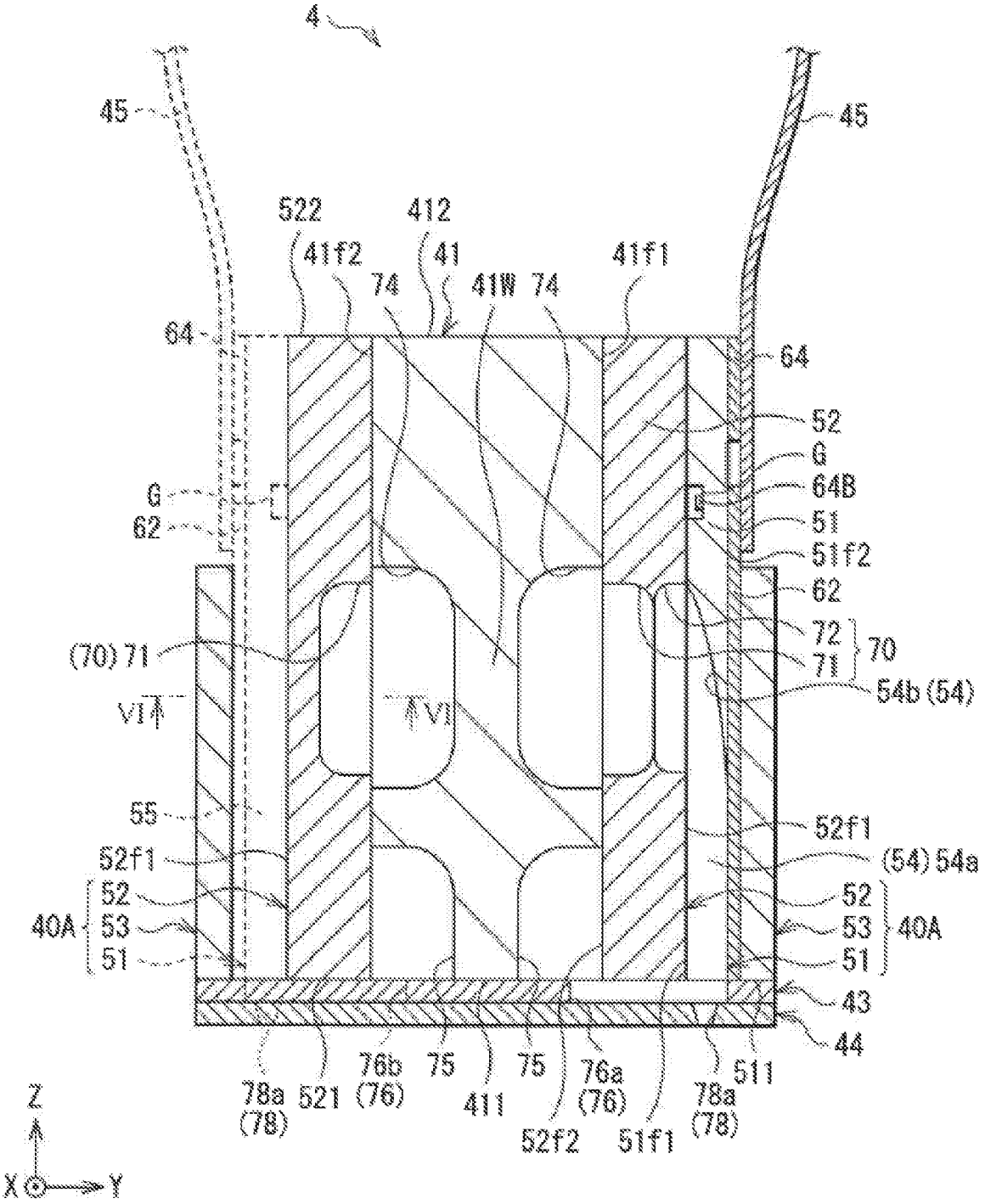
FIG. 5 is another cross-sectional view of the liquid jet head shown in FIG. 1.
Figure 6:
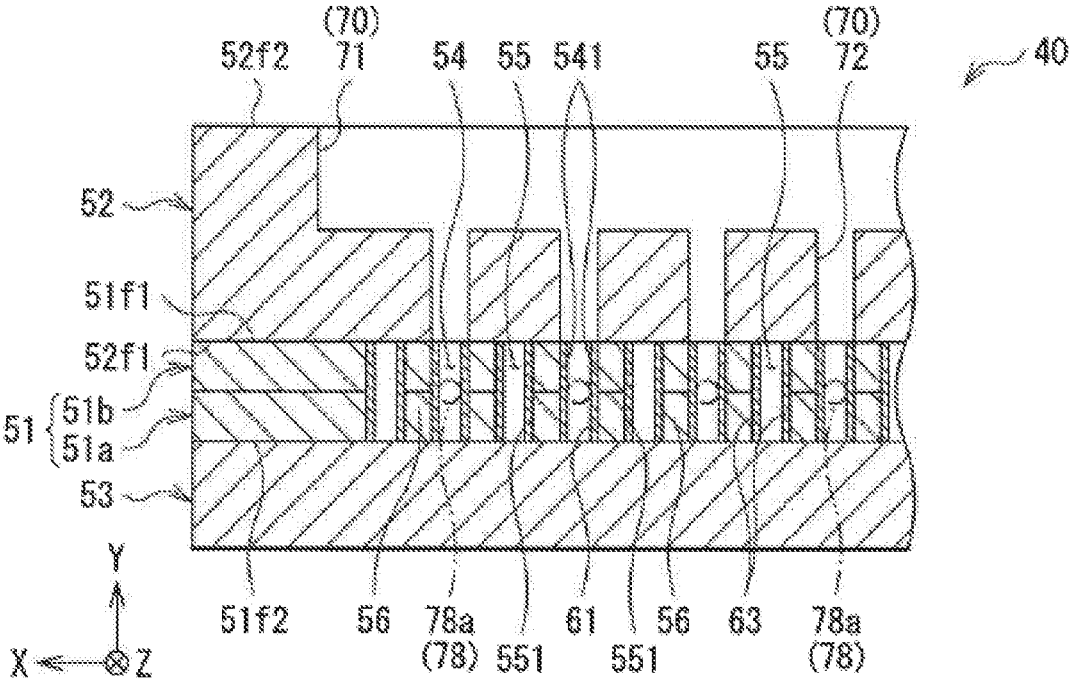
FIG. 6 is a cross-sectional view showing, in an enlarged manner, a cross-sectional surface perpendicular to an extending direction of an ejection channel in the liquid jet head shown in FIG. 1.
Figure 7:
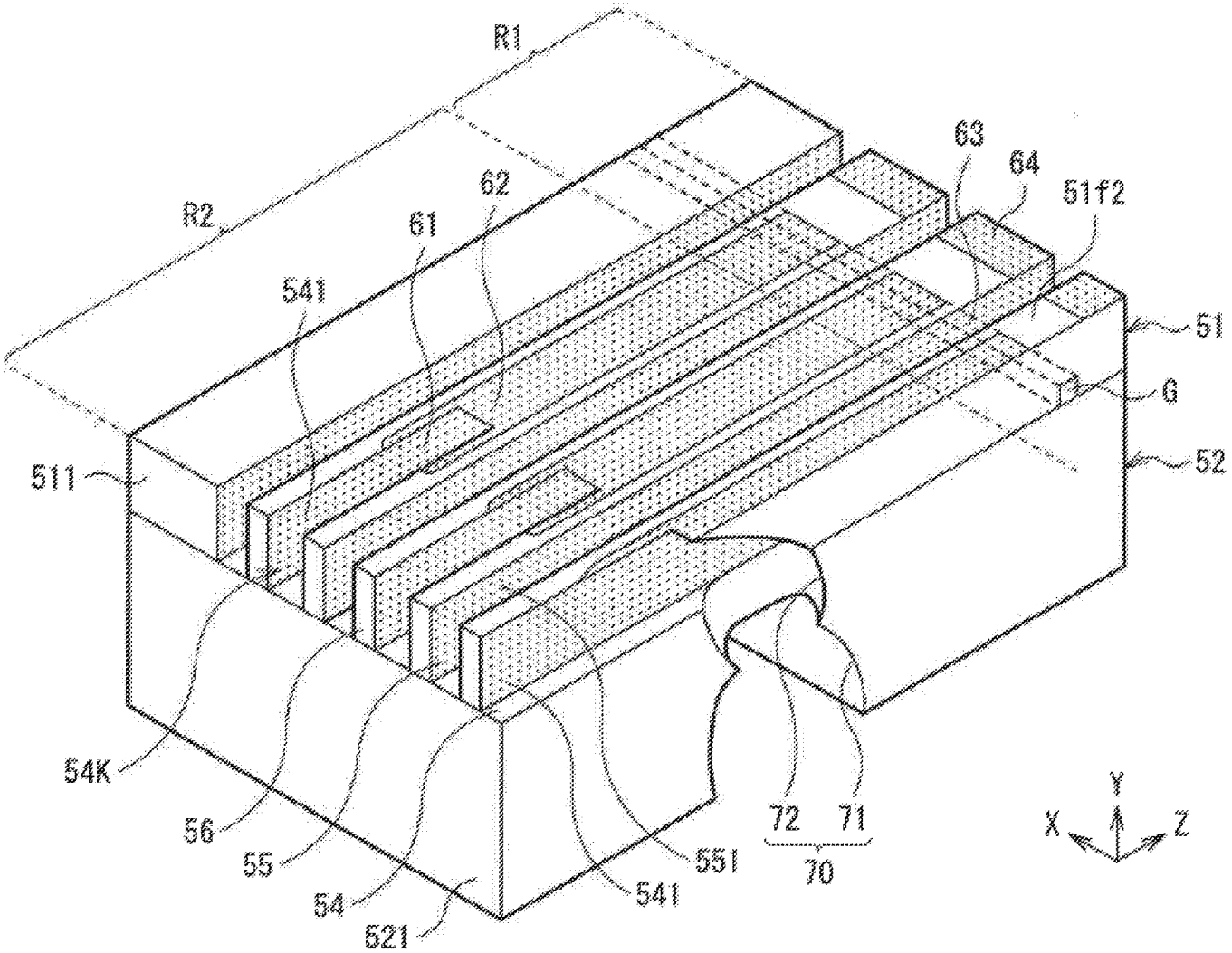
FIG. 7 is a partially broken perspective view showing, in an enlarged manner, a part of the liquid jet head chip shown in FIG. 3.

Then, the detailed configuration example of the inkjet head 4 will be described with reference to FIG. 3 through FIG. 8 in addition to FIG. 1. FIG. 3 is a perspective view showing the detailed configuration example of the inkjet head 4. FIG. 4 is a cross-sectional view showing a configuration example of the Y-Z cross-sectional surface including ejection channels 54 (described later) of a head chip 40A and dummy channels 55 (described later) of a head chip 40B in the inkjet head 4. FIG. 5 is a cross-sectional view showing a configuration example of the Y-Z cross-sectional surface including the dummy channels 55 (described later) of the head chip 40A and the ejection channels 54 (described later) of the head chip 40B in the inkjet head 4. FIG. 6 is a cross-sectional view showing, in an enlarged manner, a cross-sectional surface (the X-Y cross-sectional surface) perpendicular to the extending direction (the Z-axis direction) of the ejection channels 54 and the dummy channels 55 in the inkjet head 4. FIG. 7 is a partially broken perspective view showing a part of the head chip 40 in an enlarged manner.

As shown in FIG. 3 through FIG. 5, the inkjet head 4 is provided with the pair of head chips 40A, 40B, a flow channel plate 41, an entrance manifold 42, an exit manifold (not shown), a return plate 43, a nozzle plate (jet plate) 44, and a wiring board 45. The inkjet head 4 is of a circulation type (an edge-shoot circulation type) for circulating the ink between the inkjet head 4 and the ink tank 3 out of so-called edge-shoot types for ejecting the ink from a tip part in the extending direction (the Z-axis direction) of the ejection channel 54.

(Head Chips 40A, 40B)

The pair of head chips 40A, 40B have respective configurations substantially the same as each other, and are disposed at substantially symmetrical positions so as to have substantially symmetric postures across the flow channel plate 41 in the Y-axis direction. Hereinafter, the description will be presented collectively referring the pair of head chips 40A, 40B as head chips 40 unless the discrimination therebetween is particularly required. It should be noted that the head chip 40 corresponds to a specific example of a "head chip" in the present disclosure. The head chip 40 is provided with a cover plate 52, an actuator plate 51, and a sealing plate 53 in this order from a position near to the flow channel plate 41. It should be noted that the sealing plate 53 corresponds to a specific example of a "sealing plate" in the present disclosure.

(Actuator Plate 51)

The actuator plate 51 is a plate-like member expanding along the X-Z plane having the X-axis direction as the longitudinal direction, and the Z-axis direction as the short-side direction, and has an obverse surface 51*f*1 opposed to the cover plate 52, and a reverse surface 51*f*2 opposed to the sealing plate 53. The obverse surface 51*f*1 and the reverse surface 51*f*2 face to respective sides opposite to each other. It should be noted that the "obverse surface 51*f*1" is a specific example corresponding to a "second surface" in the present disclosure, and the "reverse surface 51*f*2" is a specific example corresponding to a "first surface" in the present disclosure. As shown in FIG. 7, the reverse surface 51*f*2 includes an end part region R1 and a channel forming region R2. The end part region R1 is a part exposed outside without overlapping the sealing plate 53, and the channel forming region R2 is a part in which the ejection channels 54 and the dummy channels 55 are formed, and which overlaps the sealing plate 53. The actuator plate 51 is a laminate substrate of a so-called chevron type obtained by stacking two piezoelectric substrates 51*a*, 51*b* having respective polarization directions different from each other in a thickness direction (the Y-axis direction) and connecting the obverse surface 51*f*1 and the reverse surface 51*f*2 to each other (see FIG. 6). As those piezoelectric substrates 51*a*, 51*b*, there are preferably used ceramics substrates formed of a piezoelectric material such as PZT (lead zirconate titanate).

The actuator plate 51 has the plurality of ejection channels 54 and the plurality of dummy channels 55 penetrating in the thickness direction (the Y-axis direction). In other words, the plurality of ejection channels 54 and the plurality of dummy channels 55 have openings on the obverse surface 51*f*1 and the reverse surface 51*f*2. The plurality of ejection channels 54 and the plurality of dummy channels 55 are each disposed so as to linearly extend in the Z-axis direction. The ejection channels 54 and the dummy channels 55 are alternately disposed so as to be separated from each other in the X-axis direction. The discharge channels 54 and the dummy channels 55 are separated by drive walls 56, respectively. Therefore, the actuator plate 51 has a structure in which channels each having a slit-like shape are arranged in a cross-sectional surface (the X-Y cross-sectional surface) perpendicular to the Z-axis direction (see FIG. 6). It should be noted that the "ejection channels 54" and the "dummy channels 55" are specific examples corresponding to "ejection channels" and "non-ejection channels" in the present disclosure, respectively, and the "drive wall 56" is a specific example corresponding to a "sidewall" in the present disclosure.

The ejection channels 54 are each a part functioning as a pressure chamber for applying pressure to the ink, and each have a pair of inner surfaces 541 (the drive walls 56) opposed to each other in the X-axis direction. The pair of inner surfaces 541 are each a plane parallel to the Y-Z plane, for example. A lower end part of each of the ejection channels 54 is disposed so as to extend to a lower end surface 511 (a surface opposed to the return plate 43) of the actuator plate 51 as shown in FIG. 7 to form an opening 54K opposed to the return plate 43. The opening 54K is an ejection end from which the ink is ejected. In contrast, an upper end part of each of the ejection channels 54 terminates within the actuator plate 51 without reaching an upper end surface (a surface on an opposite side to the return plate 43) 512 of the actuator plate 51. In other words, the vicinity of the upper end part of each of the ejection channels 54 forms a closed end located between the lower end surface 511 and the upper end surface 512, and including a tilted surface 54*b*, and is formed so that the depth (the dimension in the Y-axis direction) gradually decreases in a direction toward the upper end surface 512. Therefore, a distance L1 from a crossing position between the tilted surface 54*b* and the reverse surface 51*f*2 to the lower end surface 511 as an ejection end is shorter than a second distance L2 from a crossing position between the tilted surface 54*b* and the obverse surface 51*f*1 to the lower end surface 511 (see FIG. 4).

The inner surfaces 541 of the ejection channel 54 each include a part covered with a common electrode 61 continuously from the obverse surface 51*f*1 to the reverse surface 51*f*2. It should be noted that it is also possible for the common electrode 61 to cover only a part of the inner surface 541 of the ejection channel 54. However, even in that case, it is preferable for the common electrode 61 to cover the inner surface 541 continuously from the obverse surface 51*f*1 to the reverse surface 51*f*2 in the Y-axis direction. The common electrode 61 is connected to a common electrode pad 62. The common electrode pad 62 is formed so as to cover a part of the peripheral part of the upper end part of the ejection channel 54 in the reverse surface 51*f*2. The common electrode pad 62 is disposed so as to extend from the peripheral part to the end part region R1 of the ejection channel 54 in the reverse surface 51*f*2 (FIG. 7). To the common electrode pad 62, there is coupled the wiring board 45. In other words, it is arranged that the drive voltage is applied from the wiring board 45 to the common electrode 61 via the common electrode pad 62. It should be noted that the common electrode 61 is a specific example corresponding to a "common electrode" in the present disclosure, and the common electrode pad 62 is a specific example corresponding to a "common electrode pad" in the present disclosure.

The ejection channels 54 are filled with the ink, while it is arranged that the dummy channels 55 are not filled with the ink. As shown in FIG. 3, an upper end part of the dummy channel 55 opens in the upper end surface 512, and a lower end part of the dummy channel 55 opens in the lower end surface 511.

As shown in FIG. 6, the dummy channels 55 each have a pair of inner surfaces 551 (the drive walls 56) opposed to each other in the X-axis direction. The pair of inner surfaces 551 are each a plane parallel to the Y-Z plane, for example. The pair of inner surfaces 551 each include a part covered with an individual electrode 63 continuously from the obverse surface 51*f*1 to the reverse surface 51*f*2. It should be noted that the individual electrode 63 can also be an electrode covering only a part of the inner surface 551 of the dummy channel 55. Further, the pair of individual electrodes 63 for respectively covering the pair of drive walls 56 in the dummy channel 55 are isolated from each other. The individual electrodes 63 are coupled to individual electrode pads 64 each covering a part of the end part region R1 of the reverse surface 51*f*2. It should be noted that in the present embodiment, the individual electrode pads 64 are each disposed so as to extend in a part located above the common electrode pad 62 out of the peripheral part (FIG. 7). The individual electrode pads 64 each couple a pair of individual electrodes 63 adjacent to each other across the ejection channel 54. Here, the individual electrodes 63 and the individual electrode pad 64 are electrically isolated from the common electrodes 61 and the common electrode pad 62. To the individual electrode pad 64, there is coupled the wiring board 45. In other words, it is arranged that the drive voltage is applied from the wiring board 45 to the pair of individual electrodes 63 via the individual electrode pad 64. It should be noted that the individual electrode 63 is a specific example corresponding to an "individual electrode" in the present disclosure, and the individual electrode pad 64 is a specific example corresponding to an "individual electrode pad" in the present disclosure.

In the present embodiment, in order to couple the pair of individual electrodes 63 adjacent to each other across the ejection channel 54 to each other, the actuator plate 51 is provided with a bypass electrode 64B in addition to the individual electrode pad 64. The bypass electrode 64B is disposed so as to be separated from the individual electrode pad 64. In other words, the bypass electrode 64B is disposed at a different position from the individual electrode pad 64. Although the details will be described later, according to this configuration, even if the individual electrode pad 64 is broken, the pair of individual electrodes 63 are electrically coupled to each other.

The bypass electrode 64B is disposed inside a bypass groove G provided to the obverse surface 51*f*1, for example. It is sufficient for the bypass electrode 64B to be disposed at a position not exposed on the reverse surface 51*f*2 on which the common electrode pad 62 is disposed. For example, it is also possible to arrange that the bypass electrode 64B is disposed on the obverse surface 51*f*1 without disposing the bypass groove G. Alternatively, it is also possible to dispose a tunnel-like hole extending in the X-axis direction between the reverse surface 51*f*2 and the obverse surface 51*f*1, and then dispose the bypass electrode 64B in this hole. Although the details will be described later, by disposing the bypass electrode 64B at the position not exposed on the reverse surface 51*f*2 as described above, occurrence of the short circuit between the wiring board 45 coupled to the common electrode pad 62 and the bypass electrode 64B can be prevented.

The bypass groove G where the bypass electrode 64B is disposed is disposed in the end part region R1 of the obverse surface 51*f*1, and extends in a direction (e.g., the X-axis direction shown in FIG. 7) in which the ejection channels 54 and the dummy channels 55 are arranged. For example, the actuator plate 51 is provided with the single bypass groove G, and the bypass groove G is communicated with all of the dummy channels 55. It is also possible for the bypass grooves G to be disposed so as to be separated from each other so as to connect the pair of dummy channels 55 adjacent to each other across the ejection channel 54. The bypass groove G is disposed at a position closer to the channel forming region R2 than, for example, a position opposed to the individual electrode pad 64 of the reverse surface 51*f*2. For example, the bypass groove G is disposed at a position opposed to the vicinity of the upper end part of the common electrode pad 62 of the reverse surface 51*f*2. It is sufficient for the depth (the size in the Y-axis direction) of the bypass groove G to be a level capable of housing the bypass electrode 64B.

The bypass electrode 64B disposed inside the bypass groove G is coupled to the pair of individual electrodes 63 adjacent to each other across the ejection channel 64. Inside the bypass groove G, there are disposed two or more bypass electrodes 64B so as to be separated from each other. The width (the size in the Z-axis direction) of the bypass electrode 64B is made smaller than, for example, the width of the bypass groove G. The width of the bypass electrode 64B can also be roughly equal to the width of the bypass groove G. Alternatively, it is also possible for the bypass electrode 64B to be disposed throughout an area from a bottom surface to a side surface of the bypass groove G. The bypass electrode 64B is formed of, for example, the same material as the constituent material of the common electrodes 61 and the individual electrodes 63.

(Cover Plate 52)

The cover plate 52 is a plate-like member having the X-axis direction as the longitudinal direction and the Z-axis direction as the short-side direction, and extending along the X-Z plane. The cover plate 52 has an opposed surface 52*f*1 opposed to the obverse surface 51*f*1 of the actuator plate 51.

Figure 8:
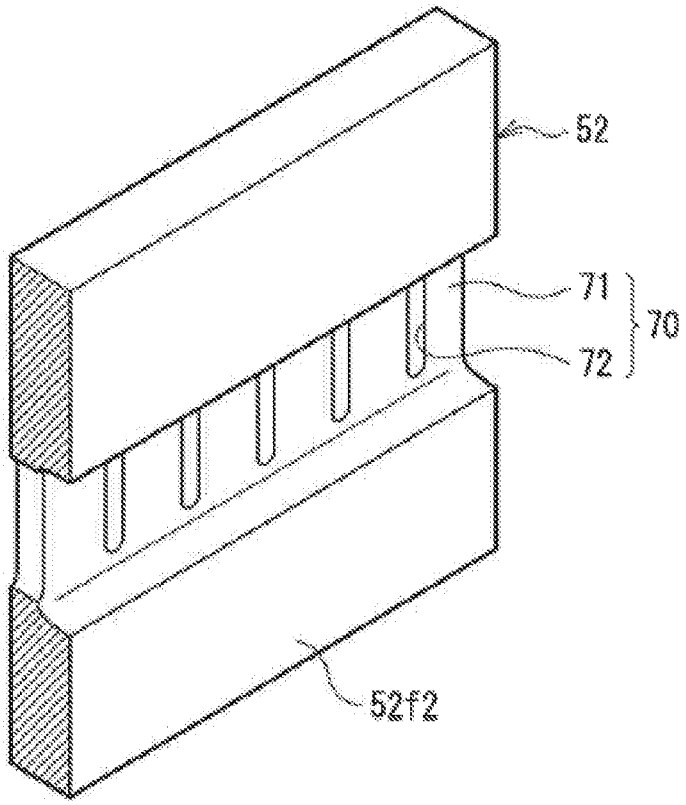
FIG. 8 is a perspective view showing, in an enlarged manner, a cover plate shown in FIG. 3.

FIG. 8 is a perspective view of the cover plate 52 viewed from the flow channel plate 41 side. The cover plate 52 is provided with a liquid supply channel 70 penetrating the cover plate 52 in the Y-axis direction (the thickness direction), and at the same time communicated with the ejection channels 54. The liquid supply channel 70 is a specific example corresponding to a "liquid flow hole" in the present disclosure. The liquid supply channel 70 includes a common ink chamber 71 opening on the flow channel plate 41 side in the Y-axis direction, and a plurality of slits 72 each communicated with the common ink chamber 71, and at the same time opening on the actuator plate 51 side in the Y-axis direction. The plurality of slits 72 is disposed at positions corresponding to the plurality of ejection channels 54. The common ink chamber 71 is disposed commonly to the plurality of slits 72, and is communicated with the ejection channels 54 through the plurality of slits 72. The common ink chamber 71 is not communicated with the dummy channels 55.

The common ink chamber 71 is provided to an opposed surface 52*f*2 opposed to the flow channel plate 41 in the cover plate 52. The common ink chamber 71 is disposed at substantially the same position as the tilted surfaces 54*b* of the ejection channels 54 in the Z-axis direction. The common ink chamber 71 is formed to have a groove-like shape recessed toward the opposed surface 52*f*1, and at the same time extending in the X-axis direction. It is arranged that the ink inflows into the common ink chamber 71 through the flow channel plate 41.

The plurality of slits 72 is provided to the opposed surface 52*f*1 opposed to the actuator plate 51. The plurality of slits 72 is arranged at positions each overlapping a part of the common ink chamber 71 in the Y-axis direction. The plurality of slits 72 is communicated with the common ink chamber 71 and the plurality of ejection channels 54. It is desirable for the width in the X-axis direction of each of the slits 72 to substantially the same as the width in the X-axis direction of each of the ejection channels 54.

It should be noted that it is preferable for the cover plate 52 to be formed of a material having an insulating property, and having thermal conductivity equal to or higher than the thermal conductivity of a material constituting the actuator plate 51. For example, in the case of forming the actuator plate 51 with PZT, it is preferable for the cover plate 52 to be formed of PZT or silicon. This is because thus the difference between the temperature of the cover plate 52 of the head chip 40A and the temperature of the cover plate 52 of the head chip 40B is reduced, and it is possible to achieve the homogenization of the ink temperature inside the inkjet head 4. As a result, the variation in ejection speed of the ink is reduced, and the printing stability is improved.

(Sealing Plate 53)

The sealing plate 53 is a plate-like member having the X-axis direction as the longitudinal direction and the Z-axis direction as the short-side direction, and extending along the X-Z plane similarly to the cover plate 52. The sealing plate 53 has a lower end surface 531 coinciding with the lower end surface 511 of the actuator plate 51 and a lower end surface 521 of the cover plate 52 in the Z-axis direction, and an upper end surface 532 located on an opposite side to the lower end surface 531 in the Z-axis direction. The upper end surface 532 is located at a position retracting from the upper end surface 512 and an upper end surface 522 in the Z-axis direction. The sealing plate 53 further has an opposed surface 53*f*1 opposed to the reverse surface 51*f*2 of the actuator plate 51. The sealing plate 53 is disposed so that the opposed surface 53*f*1 faces the channel forming region R2 out of the reverse surface 51*f*2 of the actuator plate 51. Therefore, it is arranged that the plurality of ejection channels 54 and the plurality of dummy channels 55 are closed by the sealing plate 53 and the cover plate 52. The sealing plate 53 is not required to have an opening, a cutout, a groove, or the like. In other words, since it is sufficient for the sealing plate 53 to be a simple rectangular solid, it is possible to use a functional material difficult to fabricate, or a low-price material difficult to obtain high processing accuracy as the constituent material thereof. Therefore, the degree of freedom of selection of a material type is enhanced.

It is preferable for the sealing plate 53 to be formed of a material high in thermal conductivity. The sealing plate 53 is formed of, for example, PZT or silicon. When the sealing plate 53 formed of the material high in thermal conductivity is bonded to the reverse surface 51*f*2 of the actuator plate 51, unevenness of the heat in the actuator plate 51 caused when driving decreases. Thus, the difference between the temperature of the actuator plate 51 of the head chip 40A and the temperature of the actuator plate 51 of the head chip 40B is reduced, and it is possible to achieve the homogenization of the ink temperature inside the inkjet head 4. As a result, the variation in ejection speed of the ink is reduced, and the printing stability is improved.

(Arrangement Relationship Between Pair of Head Chips 40A, 40B)

As shown in FIG. 3, the pair of head chips 40A, 40B are disposed across the flow channel plate 41 in the Y-axis direction in the state in which the respective opposed surfaces 52*f*2 are opposed to each other in the Y-axis direction.

The ejection channels 54 and the dummy channels 55 of the head chip 40B are arranged so as to be shifted as much as a half pitch in the X-axis direction with respect to the arrangement pitch of the ejection channels 54 and the dummy channels 55 of the head chip 40A. In other words, the ejection channels 54 and the dummy channels 55 of the head chip 40A and the ejection channels 54 and the dummy channels 55 of the head chip 40B are arranged in a zigzag manner.

Therefore, as shown in FIG. 4, the ejection channels 54 of the head chip 40A and the dummy channels 55 of the head chip 40B are opposed to each other in the Y-axis direction. Similarly, as shown in FIG. 5, the dummy channels 55 of the head chip 40A and the ejection channels 54 of the head chip 40B are opposed to each other in the Y-axis direction. It should be noted that the pitch of the ejection channels 54 and the dummy channels 55 in each of the head chips 40A, 40B can arbitrarily be changed.

(Flow Channel Plate 41)

The flow channel plate 41 is sandwiched between the head chip 40A and the head chip 40B in the Y-axis direction. It is preferable for the flow channel plate 41 to be integrally formed of the same member. As shown in FIG. 3, the flow channel plate 41 has a rectangular plate-like shape having the X-axis direction as the longitudinal direction, and the Y-axis direction as the short-side direction. When viewed from the Y-axis direction, the outer shape of the flow channel plate 41 is substantially the same as the outer shape of the cover plate 52.

To a principal surface 41*f*1 (a surface facing the head chip 40A) in the Y-axis direction of the flow channel plate 41, there is bonded the opposed surface 52*f*2 in the head chip 40A. To a principal surface 41*f*2 (a surface facing the head chip 40B) in the Y-axis direction of the flow channel plate 41, there is bonded the opposed surface 52*f*2 in the head chip 40B.

As shown in FIG. 4 and FIG. 5, to the principal surfaces 41*f*1, 41*f*2 of the flow channel plate 41, there are respectively provided entrance flow channels 74 individually communicated with the common ink chamber 71, and exit flow channels 75 individually communicated with circulation channels 76 of the return plate 43. It should be noted that the entrance flow channel 74 corresponds to a specific example of a "liquid supply flow channel" in the present disclosure, and the exit flow channel 75 corresponds to a specific example of a "liquid discharge flow channel" in the present disclosure.

As shown in FIG. 3, the exit flow channel 75 is recessed from each of the principal surfaces 41*f*1, 41*f*2 of the flow channel plate 41 inward in the Y-axis direction, and at the same time, recessed from the lower end surface 411 of the flow channel plate 41 toward the upper end surface 412. One end part of each of the exit flow channels 75 opens in the other end surface in the X-axis direction of the flow channel plate 41. Each of the exit flow channels 75 bends downward from the other end surface in the X-axis direction of the flow channel plate 41 so as to have a crank-like shape, and then extends linearly toward the one end side in the X-axis direction. It is preferable for the width in the Z-axis direction of the exit flow channel 75 to be smaller than the width in the Z-axis direction of the entrance flow channel 74 as shown in FIG. 4. Further, the depth in the Y-axis direction of the exit flow channel 75 is substantially the same as the depth in the Y-axis direction of the entrance flow channel 74. The exit flow channels 75 are coupled to an exit manifold (not shown) on the other end surface in the X-axis direction of the flow channel plate 41. The exit manifold is coupled to the ink discharge tube 82 (see FIG. 1).

(Entrance Manifold 42)

As shown in FIG. 3, the entrance manifold 42 is bonded to one end surfaces in the X-axis direction of the head chips 40A, 40B and the flow channel plate 41. The entrance manifold 42 is provided with a supply channel 77 communicated with the pair of entrance flow channels 74. An end part on the opposite side to the flow channel plate 41 in the supply channel 77 is coupled to the ink supply tube 81 (see FIG. 1).

(Return Plate 43)

The return plate 43 has a rectangular plate-like shape having the X-axis direction as the longitudinal direction, and the Y-axis direction as the short-side direction. The return plate 43 is collectively bonded to the lower end surfaces 511, 521, and 531 of the head chips 40A, 40B and the lower end surface 411 of the flow channel plate 41. In other words, the return plate 43 is disposed on the opening 54K side of each of the ejection channels 54 in the head chip 40A and the head chip 40B. The return plate 43 is a spacer plate intervening between the openings 54K of the ejection channels 54 in the head chip 40A and the head chip 40B, and an upper surface of the nozzle plate 44. The return plate 43 is provided with a plurality of circulation channels 76 for coupling the ejection channels 54 of the head chips 40A, 40B and the exit flow channels 75 to each other. The plurality of circulation channels 76 includes first circulation channels 76*a* and second circulation channels 76*b*. The plurality of circulation channels 76 penetrates the return plate 43 in the Z-axis direction.

(Nozzle Plate 44)

As shown in FIG. 3, an outer shape of the nozzle plate 44 has a rectangular plate-like shape having the X-axis direction as the longitudinal direction, and the Y-axis direction as the short-side direction. The nozzle plate 44 is bonded to a lower end surface of the return plate 43. In the nozzle plate 44, there are arranged a plurality of nozzles 78 (jet holes) penetrating the nozzle plate 44 in the Z-axis direction. The plurality of nozzles 78 includes first nozzles 78*a* and second nozzles 78*b*. The plurality of nozzles 78 penetrates the nozzle plate 44 in the Z-axis direction.

As shown in FIG. 4, in the nozzle plate 44, the first nozzles 78*a* are each formed in a part opposed in the Z-axis direction to the first circulation channel 76*a* of the return plate 43. In other words, the first nozzles 78*a* are arranged on a straight line at intervals in the X-axis direction at the same pitch as that of the first circulation channels 76*a*. The first nozzles 78*a* are each communicated with the first circulation channel 76*a* in an outer end part in the Y-axis direction in the first circulation channel 76*a*. Thus, the first nozzles 78*a* are communicated with the corresponding ejection channels 54 of the head chip 40A via the first circulation channels 76*a*, respectively.

As shown in FIG. 5, in the nozzle plate 44, the second nozzles 78*b* are each formed in a part opposed in the Z-axis direction to the second circulation channel 76*b* of the return plate 43. In other words, the second nozzles 78*b* are arranged on a straight line at intervals in the X-axis direction at the same pitch as that of the second circulation channels 76*b*. The second nozzles 78*b* are each communicated with the second circulation channel 76*b* in an outer end part in the Y-axis direction in the second circulation channel 76*b*. Thus, the second nozzles 78*b* are communicated with the corresponding ejection channels 54 of the head chip 40B via the second circulation channels 76*b*, respectively. The dummy channels 55 are not communicated with the first nozzles 78*a* and the second nozzles 78*b*, and are covered with the return plate 43 from below.

(Wiring Board 45)

The wiring board 45 electrically connects each of the common electrode pads 62 and the individual electrode pads 64 to a drive circuit. The wiring board 45 is provided with, for example, a plurality of extraction electrodes respectively connected to the plurality of common electrode pads 62, and a plurality of extraction electrodes respectively connected to the plurality of individual electrode pads 64. The drive circuit is formed of, for example, an integrated circuit (IC). The integrated circuit can also be mounted on the wiring board 45. It should be noted that the "wiring board 45" is a specific example corresponding to a "wiring board" or an "external interconnection" in the present disclosure.

[Method of Manufacturing Inkjet Head 4]

Then, a method of manufacturing the inkjet head 4 will be described. The method of manufacturing the inkjet head 4 according to the present embodiment includes a head chip manufacturing process, a flow channel manufacturing process, a plate bonding process, and a return plate and so on-bonding process. It should be noted that the head chip manufacturing process can be performed by substantially the same methods for the head chip 40A and the head chip 40B. Therefore, in the following description, the head chip manufacturing process in the head chip 40A will be described.

(Head Chip Manufacturing Process)

The head chip manufacturing process in the method of manufacturing the inkjet head 4 according to the present embodiment mainly includes a process related to the actuator plate 51, and a process related to the cover plate 52. Among these processes, the process related to the actuator plate 51 includes, for example, a wafer preparation process, a mask pattern formation process, a channel formation process, and an electrode formation process. Hereinafter, with reference to FIG. 9A through FIG. 9J, the process related mainly to the actuator plate 51 will be described.

Figure 9A:
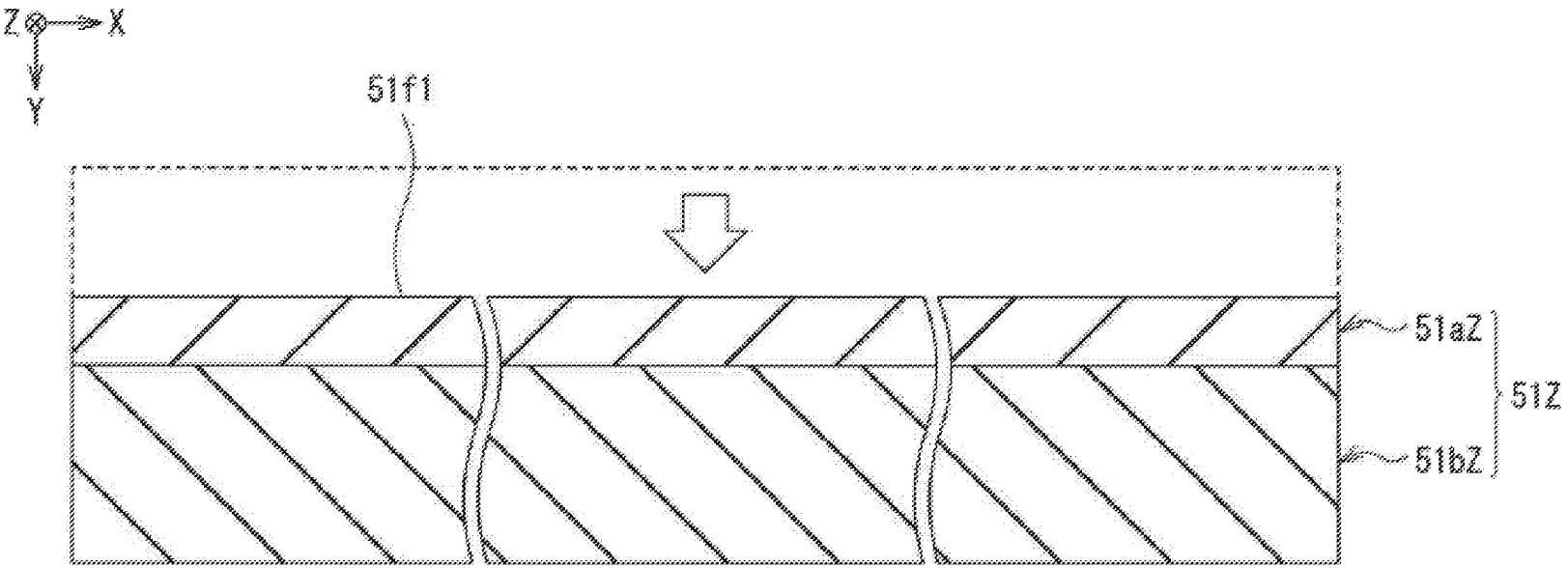
FIG. 9A is a cross-sectional view showing one process of a method of manufacturing the liquid jet head shown in FIG. 1.

In the wafer preparation process, two piezoelectric wafers 51*a*Z, 51*b*Z on which the polarization treatment has been performed in the thickness direction (the Y-axis direction) are prepared, and are stacked on one another so that the polarization directions thereof become opposite to each other as shown in FIG. 9A. Subsequently, grinding work is performed on the piezoelectric wafer 51*a*Z as needed to adjust the thickness of the piezoelectric wafer 51*a*Z. The obverse surface of the piezoelectric wafer 51*a*Z on this occasion becomes the obverse surface 51*f*1. Thus, the actuator wafer 51Z is formed.

Figure 9B:
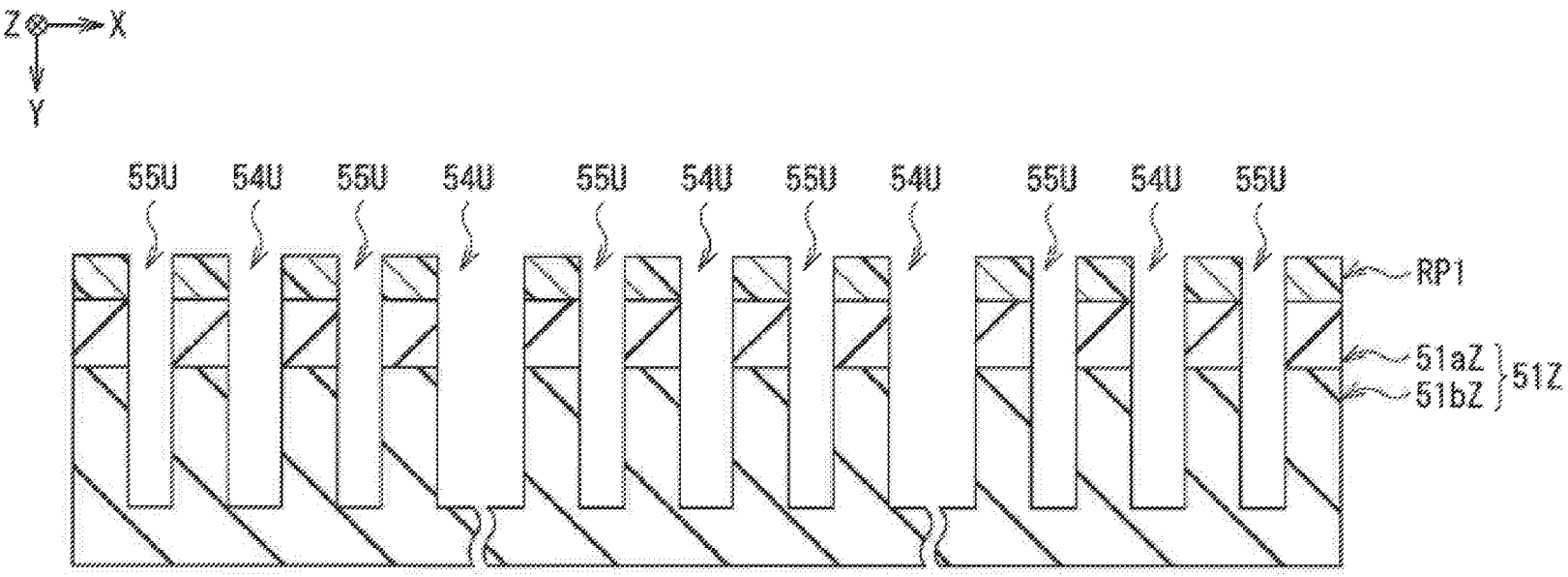
FIG. 9B is a cross-sectional view showing one process following the process shown in FIG. 9A.

Due to the subsequent mask pattern formation process, as shown in FIG. 9B, a resist pattern RP1 to be used as a mask when forming the common electrodes 61 and so on is formed on the obverse surface 51*f*1 of the actuator wafer 51Z described above. It is also possible for the resist pattern RP1 to have a plurality of openings corresponding to the plurality of ejection channels 54 and the plurality of dummy channels 55 at predetermined positions where the plurality of ejection channels 54 and the plurality of dummy channels 55 are to be formed. It should be noted that the resist pattern RP1 can be formed of dry resist, or can also be formed of wet resist.

In the subsequent channel formation process, cutting work is performed from the obverse surface 51*f*1 of the actuator wafer 51Z described above with a dicing blade not shown or the like. Specifically, by digging down an exposed part which is not covered with the resist pattern RP1 out of the actuator wafer 51Z, a plurality of trenches 54U and a plurality of trenches 55U are formed so as to be arranged in parallel to each other at intervals in the X-axis direction, and at the same time arranged alternately (see FIG. 9B). It should be noted that the trenches 54U and the trenches 55U are parts which turn to the ejection channels 54 and the dummy channels 55 later, respectively.

For example, it is possible to provide the bypass groove G to the obverse surface 51*f*1 in the same process as the channel formation process. For example, in the resist pattern RP1, an opening is disposed in advance at a predetermined position where the bypass groove G is to be formed. Subsequently, the opening part is cut by a dicing blade or the like. Thus, it is possible to form the bypass groove G (not shown in FIG. 9B) in the same process as the process of forming the plurality of trenches 54U and the plurality of trenches 55U.

Figure 9C:
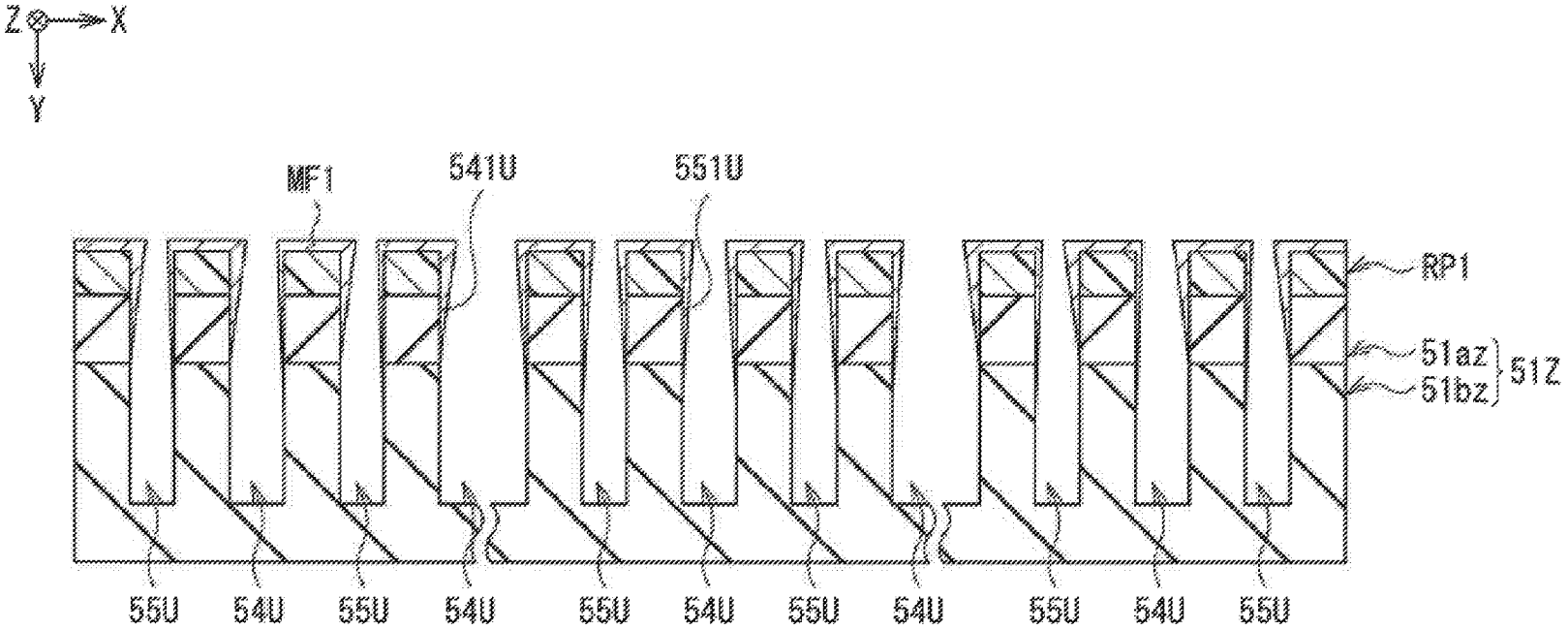
FIG. 9C is a cross-sectional view showing one process following the process shown in FIG. 9B.

In the subsequent first electrode formation process, metal coatings MF1 are formed with, for example, an evaporation method so as to cover inner surfaces 541U of the plurality of trenches 54U, inner surfaces 551U of the plurality of trenches 55U, and the resist pattern RP1 as shown in FIG. 9C. On this occasion, for example, the metal coating MF1 is also formed in the bypass groove G (not shown in FIG. 9C). Thus, the bypass electrodes 64B are formed. In the first electrode formation process, it is preferable to perform oblique vapor deposition for making the constituent material of the metal coating MF1 adhere to the inner surfaces 541U, 551U from an oblique direction to thereby cover the inner surfaces 541U of each of the trenches 54U and the inner surfaces 551U of each of the trenches 55U to positions as deep as possible in the Y-axis direction. It should be noted that it is also possible to perform a descumming treatment for removing residues such as the resist adhering to the inner surfaces 541U of each of the trenches 54U and the inner surfaces 551U of each of the trenches 55U as needed in an anterior stage to the formation of the metal coatings MF1.

Figure 9D:
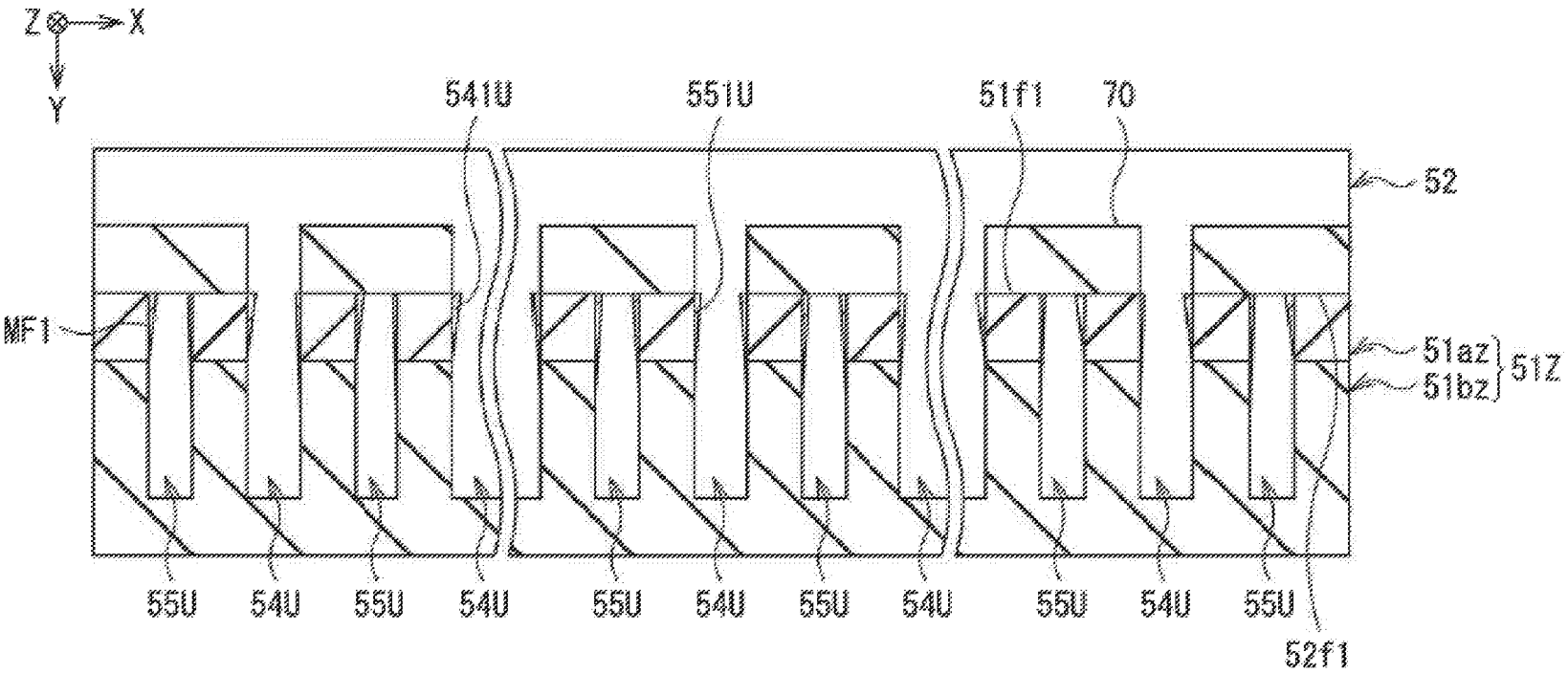
FIG. 9D is a cross-sectional view showing one process following the process shown in FIG. 9C.

Subsequently, the resist pattern RP1 is removed to thereby expose the obverse surface 51*f*1 of the actuator wafer 51Z, and then, the cover plate 52 is bonded so that the opposed surface 52*f*1 overlaps the obverse surface 51*f*1 as shown in FIG. 9D. On that occasion, the opposed surface 52*f*1 of the cover plate 52 is bonded to the obverse surface 51*f*1 so that the liquid supply channel 70 is opposed to the trenches 54U. Here, by removing the resist pattern RP1, there remain only the parts covering the inner surfaces 541U of the trenches 54U and the inner surfaces 551U of the trenches 55U out of the metal coatings MF1.

Figure 9E:
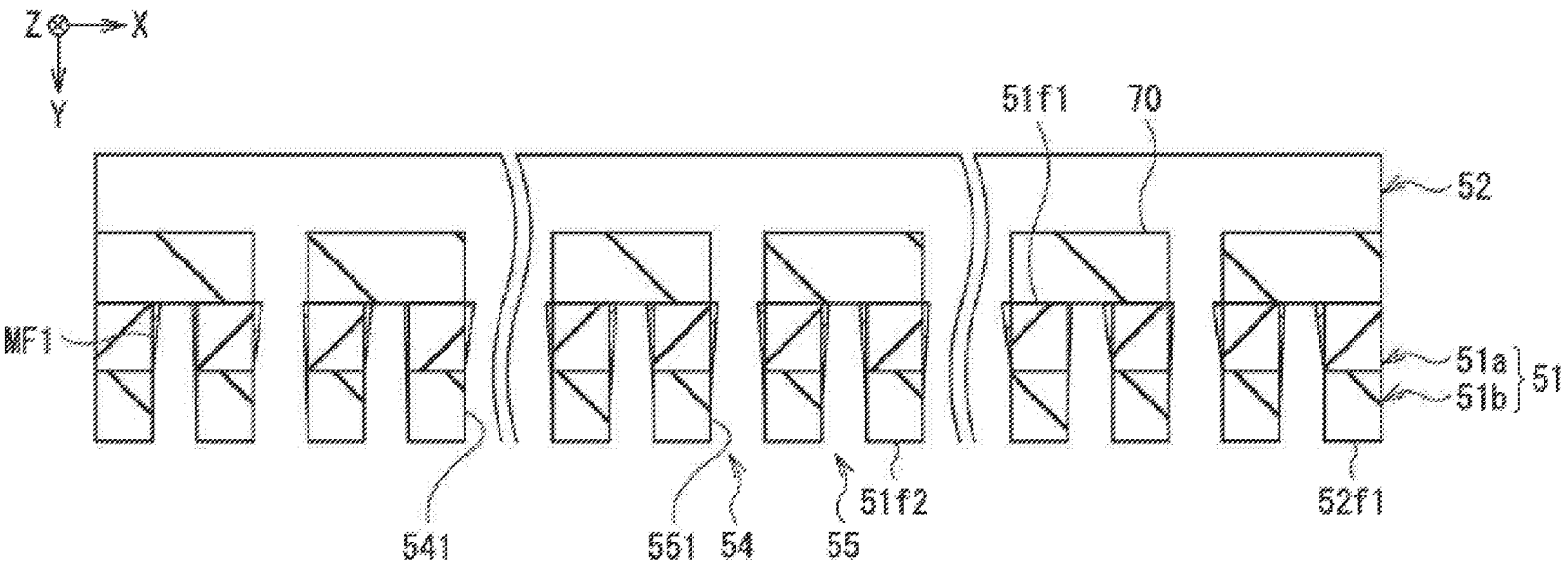
FIG. 9E is a cross-sectional view showing one process following the process shown in FIG. 9D.

Then, as shown in FIG. 9E, the grinding work is performed on the piezoelectric wafer 51*b*Z from a reverse surface (a surface on the opposite side to the piezoelectric wafer 51*a*Z) to adjust the thickness of the piezoelectric wafer 51*b*Z. On that occasion, the plurality of trenches 54U and the plurality of trenches 55U are exposed, and thus, the plurality of ejection channels 54 and the plurality of dummy channels 55 are formed. The reverse surface of the piezoelectric wafer 51*b*Z on this occasion becomes the reverse surface 51*f*2. Thus, a so-called chevron type actuator plate 51 is formed.

Figure 9F:
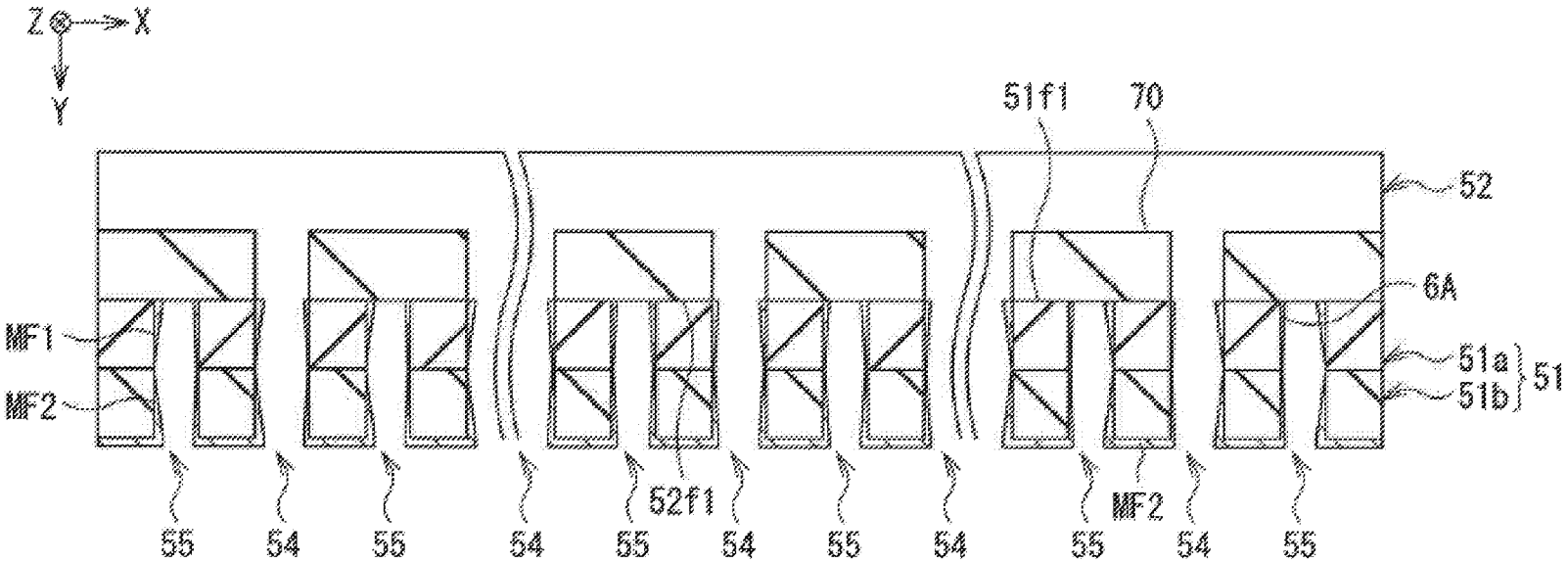
FIG. 9F is a cross-sectional view showing one process following the process shown in FIG. 9E.

In the subsequent second electrode formation process, metal coatings MF2 covering the inner surfaces of the plurality of ejection channels 54 and the inner surfaces of the plurality of dummy channels 55 are formed with, for example, an evaporation method as shown in FIG. 9F. On this occasion, it is preferable to make the metal coating MF2 have contact with the metal coating MF1, or make a part of the metal coating MF2 overlap a part of the metal coating MF1.

Figure 9G:
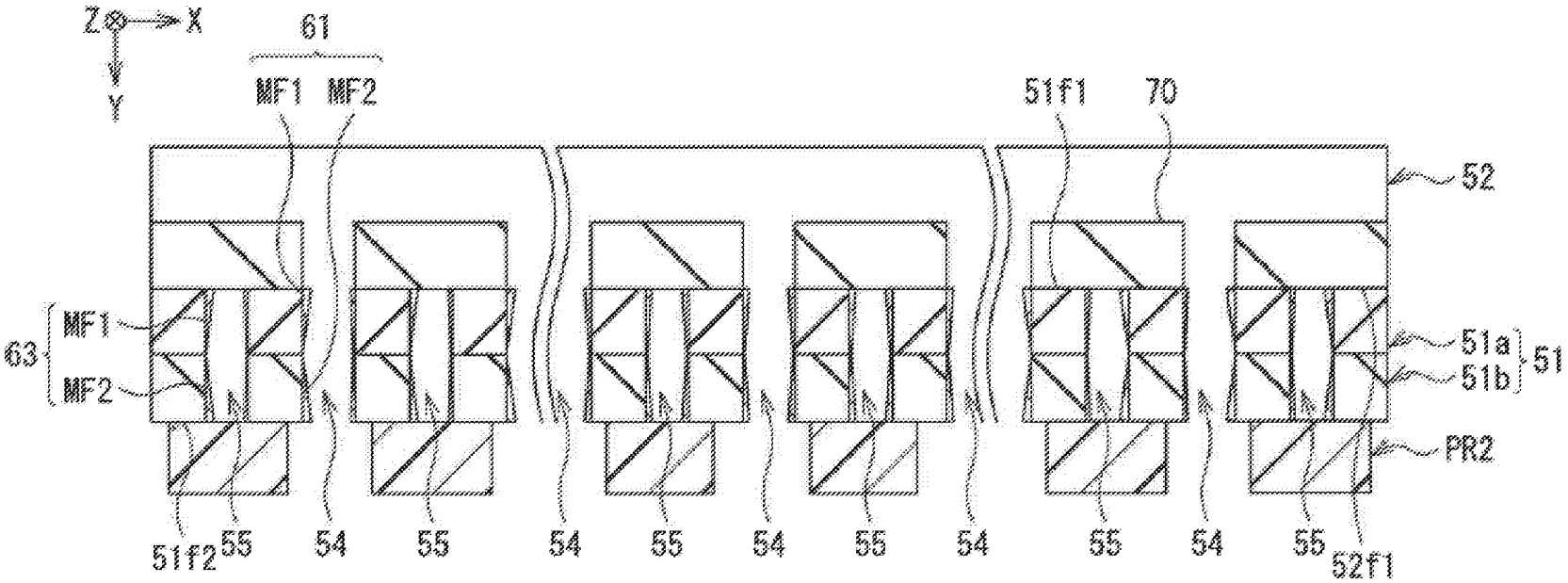
FIG. 9G is a cross-sectional view showing one process following the process shown in FIG. 9F.

Then, as shown in FIG. 9G, the part of the metal coating MF2 covering the second surface 51*f*2 is removed to thereby expose the reverse surface 51*f*2, and then, a resist pattern RP2 is selectively formed on the reverse surface 51*f*2. Here, by selectively removing the part covering the reverse surface 51*f*2 out of the metal coatings MF2, there remain only the parts covering the inner surfaces 541 of the ejection channels 54 and the inner surfaces 551 of the dummy channels 55 out of the metal coatings MF2. As a result, the common electrode 61 including the metal coatings MF1, MF2 is formed on each of the inner surfaces 541 of the ejection channels 54, and the individual electrode 63 including the metal coatings MF1, MF2 is formed on each of the inner surfaces 551 of the dummy channels 55.

Figure 9H:
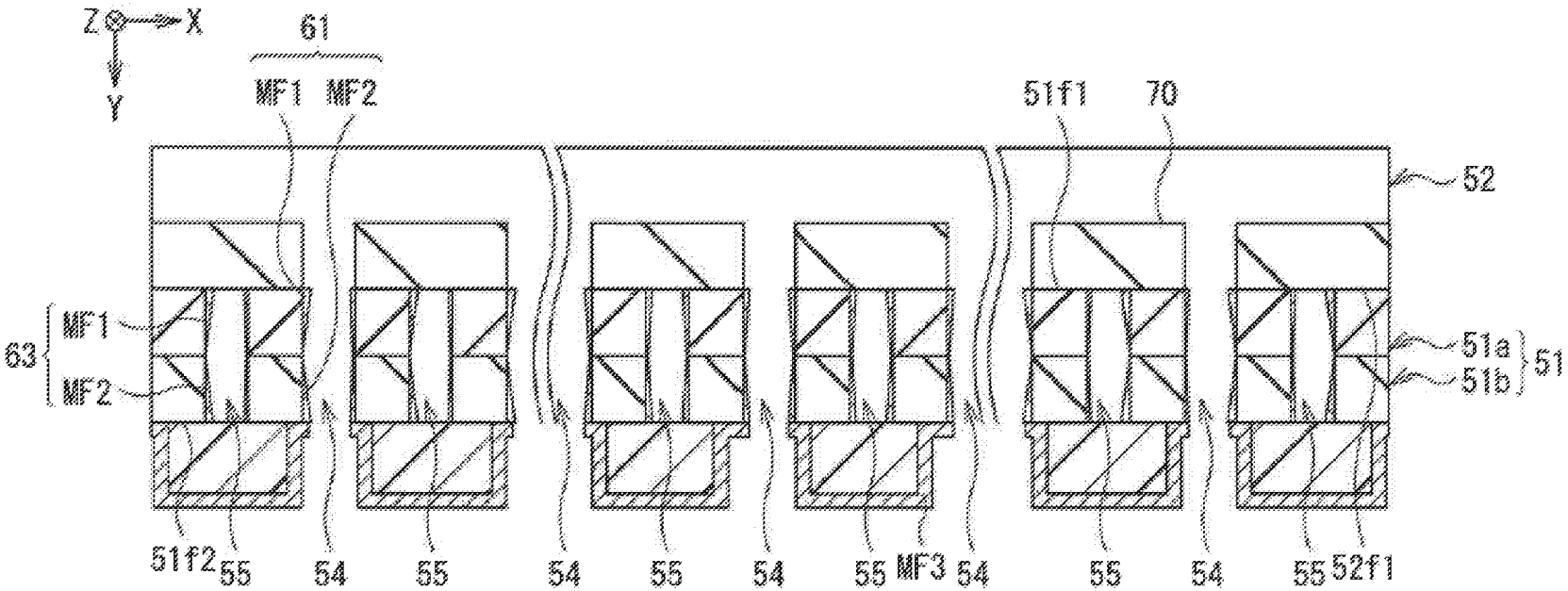
FIG. 9H is a cross-sectional view showing one process following the process shown in FIG. 9G.

Subsequently, as shown in FIG. 9H, metal coatings MF3 are formed using, for example, an evaporation method so as to cover the reverse surface 51*f*2 and the resist pattern RP2 as the third electrode formation process. On this occasion, it is preferable to make the metal coating MF3 have contact with the common electrode 61 and the individual electrode 63, or make a part of the metal coating MF3 overlap a part of the common electrode 61 and the individual electrode 63.

Figure 9I:
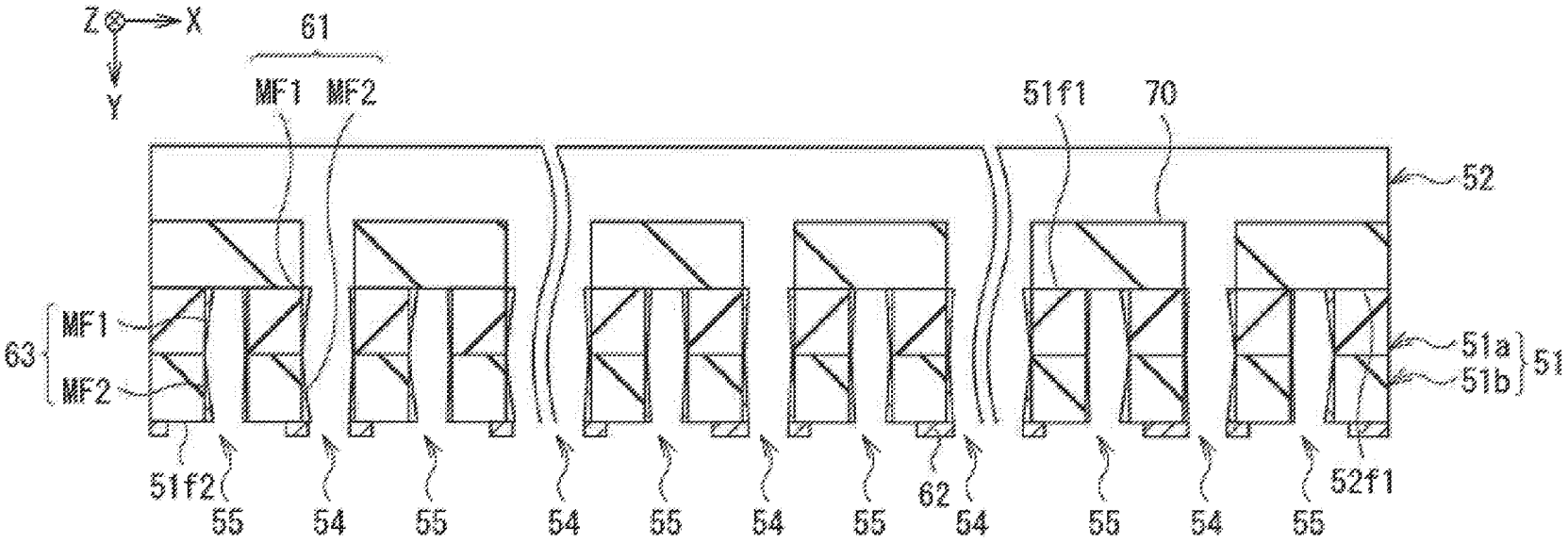
FIG. 9I is a cross-sectional view showing one process following the process shown in FIG. 9H.

Then, as shown in FIG. 9I, by removing the resist pattern RP2, some parts of the metal coatings MF3 remain on the reverse surface 51*f*2 to form the common electrode pads 62 and the individual electrode pads 64.

Figure 9J:
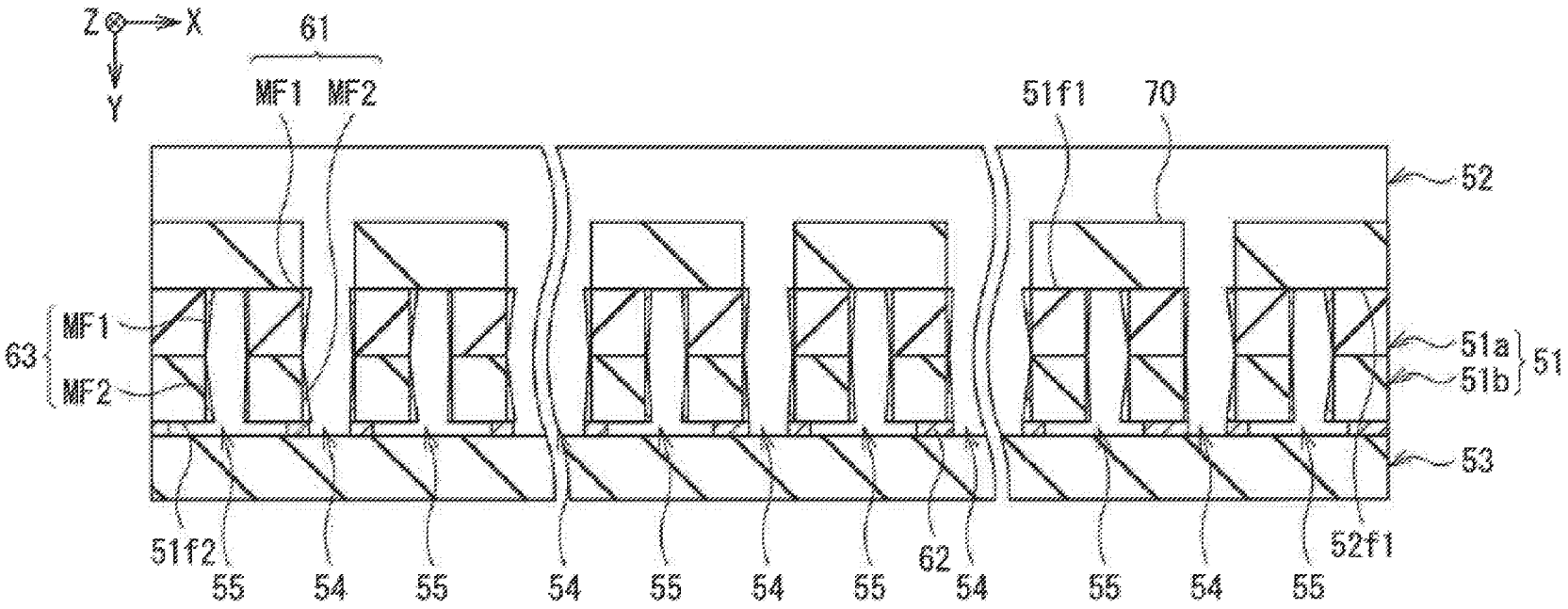
FIG. 9J is a cross-sectional view showing one process following the process shown in FIG. 9I.

Lastly, as shown in FIG. 9J, by bonding the opposed surface 53*f*1 of the sealing plate 53 to the reverse surface 51*f*2, the actuator plate 51 and the sealing plate 53 are bonded to each other. According to the above, manufacturing of the head chip 40A is completed. The head chip 40B can also be manufactured in a similar manner.

Figure 10:
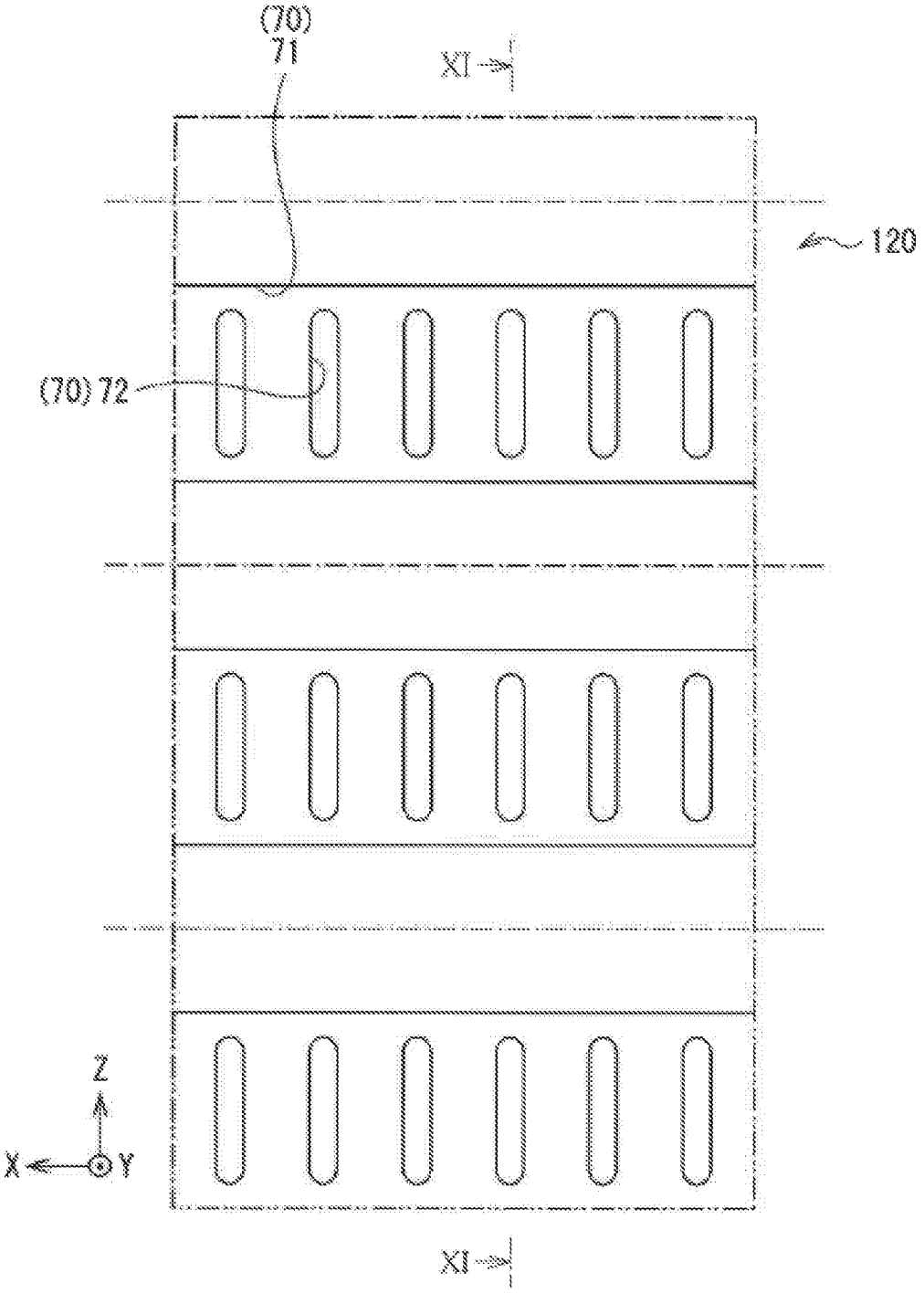
FIG. 10 is a plan view showing one process for forming the cover plate included in the method of manufacturing the liquid jet head shown in FIG. 1.
Figure 11:
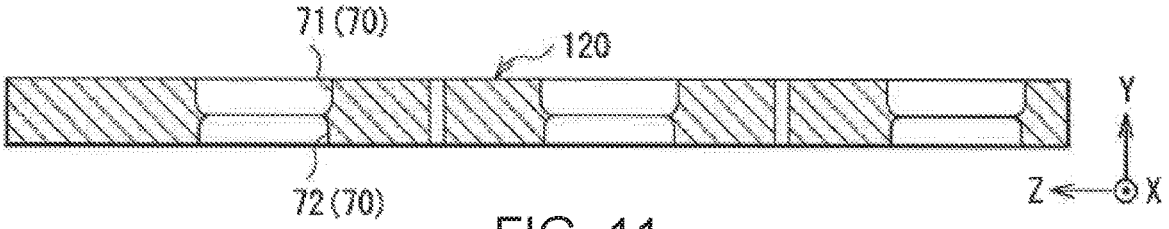
FIG. 11 is a cross-sectional view showing one process following the process shown in FIG. 10.

Here, the process related to the cover plate 52 will be described with reference mainly to FIG. 10 and FIG. 11. FIG. 10 is a plan view showing a formation process of the common ink chamber 71, and FIG. 11 is a cross-sectional view showing a formation process of the slits 72 following the process shown in FIG. 10. It should be noted that FIG. 11 shows a cross-sectional surface in the arrow direction along the cutting line XI-XI shown in FIG. 10.

As shown in FIG. 10, in the formation process of the common ink chamber 71, firstly, sandblasting or the like is performed on a cover wafer 120 prepared from the obverse surface side through a mask not shown to form the common ink chamber 71. Subsequently, as shown in FIG. 11, in the slit formation process, sandblasting or the like is performed on the cover wafer 120 from the reverse surface side through a mask not shown to form the slits 72 individually communicated with the common ink chamber 71. It should be noted that each of the formation process of the common ink chamber 71 and the formation process of the slits 72 is not limited to sandblasting, but can also be performed using dicing, cutting, or the like. Lastly, the cover wafer 120 is segmentalized along the dashed-dotted lines extending in the X-axis direction shown in FIG. 10. Thus, the cover plate 52 is completed.

(Flow Channel Plate Manufacturing Process)

The flow channel manufacturing process in the method of manufacturing the inkjet head 4 according to the present embodiment includes a flow channel formation process and a segmentalizing process.

Figure 12:
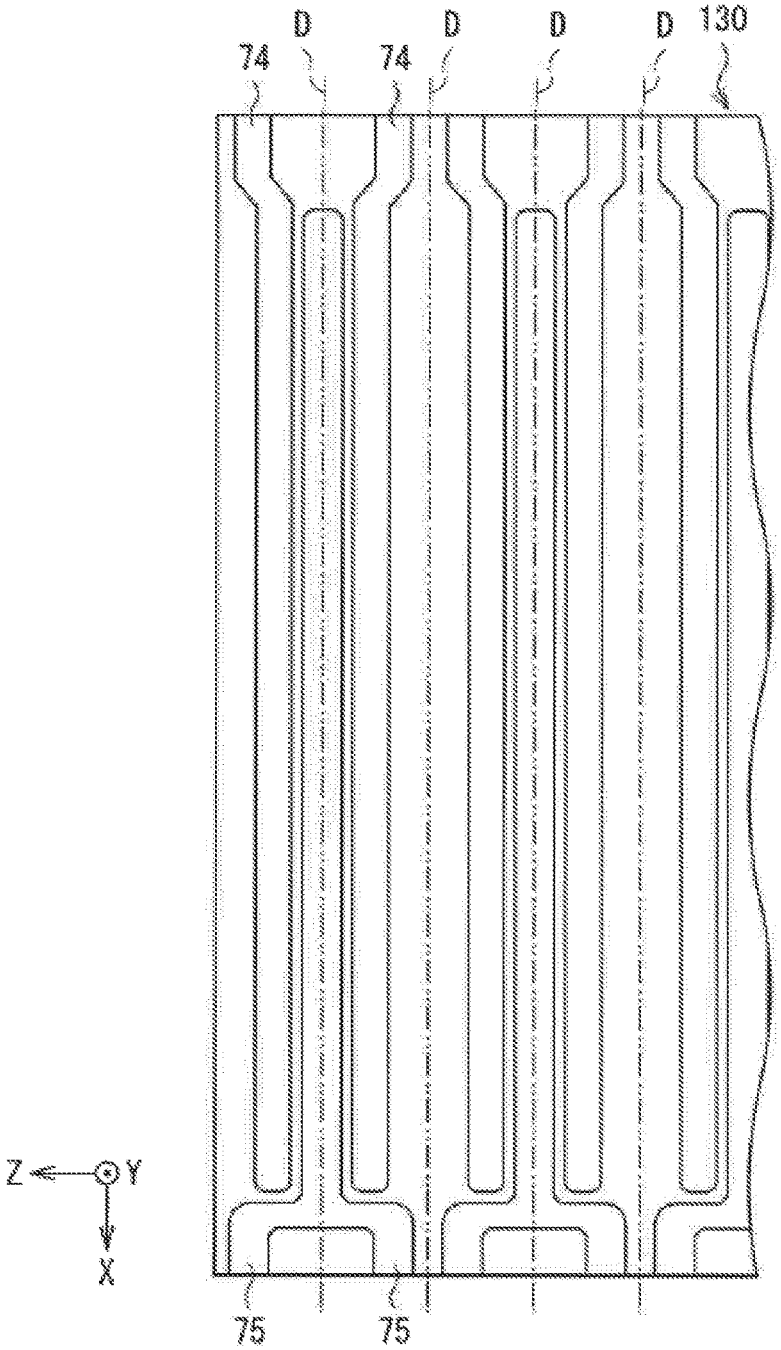
FIG. 12 is a plan view showing a process of manufacturing a flow channel plate included in the method of manufacturing the liquid jet head shown in FIG. 1.

FIG. 12 is a plan view showing the flow channel plate manufacturing process. As shown in FIG. 12, in the flow channel formation process, firstly, sandblasting or the like is performed on a flow channel wafer 130 from the obverse surface side through a mask not shown to form each of the entrance flow channels 74 on the obverse surface side and the exit flow channels 75 on the obverse surface side.

In addition, in the flow channel formation process, sandblasting or the like is performed on the flow channel wafer 130 from the reverse surface side through a mask not shown to form the entrance flow channels 74 on the reverse surface side and the exit flow channels 75 on the reverse surface side. It should be noted that each process in the flow channel formation process is not limited to sandblasting, but can also be performed using dicing, cutting, or the like.

In the segmentalizing process following the flow channel formation process, the flow channel wafer 130 is segmentalized along the axis lines (the imaginary lines D shown in FIG. 13) of straight line parts in the X-axis direction in the exit flow channels 75 using a dicer or the like. Thus, the flow channel plate 41 (see FIG. 3) is completed.

(Various-Plate Bonding Process)

As shown in FIG. 3, in the various-plate bonding process, each of the cover plate 52 of the head chip 40A and the cover plate 52 of the head chip 40B is bonded to the flow channel plate 41. Specifically, the principal surface 41*f*1 of the flow channel plate 41 is bonded to the opposed surface 52*f*2 of the head chip 40A, and at the same time, the principal surface 41*f*2 of the flow channel plate 41 is bonded to the opposed surface 52*f*2 of the head chip 40B. Thus, a plate bonded body is manufactured. It should be noted that it is also possible to arrange that the plate bonded body obtained by sequentially bonding the cover plate 52 of the head chip 40A and the cover plate 52 of the head chip 40B to each other is manufactured by bonding one cover wafer 120 to each of the both surfaces of the flow channel wafer 130, and then performing chip separation (segmentalization).

(Return Plate and so On-Bonding Process)

Subsequently, the return plate 43 and the nozzle plate 44 are bonded to the plate bonded body described above. Subsequently, the wiring board 45 is mounted on the common electrode pads 62 and the individual electrode pads 64 (see FIG. 4, FIG. 5).

According to the above, the inkjet head 4 according to the present embodiment is completed.

[Operations and Functions/Advantages]

(A. Basic Operation of Printer 1)

In the printer 1, the recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink of the corresponding colors (the four colors), respectively. Further, there is achieved the state in which the inkjet heads 4 are filled with the ink in the ink tanks 3 via the ink circulation mechanism 8, respectively. More specifically, there is achieved the state in which a predetermined amount of ink is supplied to the head chips 40 via the ink supply tube 81 and the flow channel plate 41 to fill the ejection channels 54 via the liquid supply channels 70.

In such an initial state, when operating the printer 1, the grit rollers 21 in the carrying mechanisms 2*a*, 2*b* each rotate to thereby carry the recording paper P along the carrying direction d (the X-axis direction) while being held between the grit rollers 21 and the pinch rollers 22. Further, at the same time as such a carrying operation, the drive motor 38 in the drive mechanism 34 rotates each of the pulleys 35, 36 to thereby operate the endless belt 37. Thus, the carriage 33 reciprocates along the width direction (the Y-axis direction) of the recording paper P while being guided by the guide rails 31, 32. Then, on this occasion, the four colors of ink are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Then, the detailed operation (the jet operation of the ink) in the inkjet head 4 will be described with reference to FIG. 1 through FIG. 8. Specifically, in the inkjet head 4 (edge-shoot type) according to the present embodiment, the jet operation of the ink using a shear mode is performed in the following manner. It should be noted that the following jet operation is performed by a drive circuit (not shown) mounted on the inkjet head 4.

In such an inkjet head 4 which is the edge-shoot type, and is the circulation type as in the present embodiment, firstly, the pressure pump 84 and the suction pump 85 shown in FIG. 2 are operated to thereby make the ink flow through the circulation flow channel 83. On this occasion, the ink flowing through the ink supply tube 81 passes through the supply channel 77 of the entrance manifold 42 shown in FIG. 3, and inflows into the entrance flow channels 74 of the flow channel plate 41. The ink having flowed into the entrance flow channels 74 passes through the common ink chambers 71, and is then supplied to the ejection channels 54 through the slits 72. The ink having flowed into the ejection channels 54 reaggregates in the exit flow channels 75 via the circulation channels 76 of the return plate 43, then passes through the exit manifold, and is then discharged to the ink discharge tube 82 shown in FIG. 2. The ink discharged to the ink discharge tube 82 is returned to the ink tank 3, and is then supplied to the ink supply tube 81 again. Thus, the ink is circulated between the inkjet head 4 and the ink tank 3.

Then, when the reciprocation is started by the carriage 33 (see FIG. 1), drive voltages are applied between the common electrodes 61 and the individual electrodes 63 via the wiring board 45. On this occasion, for example, the individual electrode 63 is set to a drive potential Vdd, and the common electrode 61 is set to a reference potential GND. When applying the drive voltage between the common electrode 61 and the individual electrode 63, a thickness-shear deformation occurs in the two drive walls 56 for defining the ejection channel 54, and the two drive walls 56 deform so as to protrude toward the dummy channels 55. Specifically, since the actuator plate 51 has a structure in which the two piezoelectric substrates 51*a*, 51*b* on which the polarization treatment has been performed in the thickness direction (the Y-axis direction) are stacked on one another, by applying the drive voltage described above, the actuator plate 51 makes a flexural deformation to have a V-shape centered on the intermediate position in the Y-axis direction in the drive walls 56. Thus, the ejection channel 54 deforms as if it bulges.

When the capacity of the ejection channel 54 increases due to the deformation of the two drive walls 56 defining the ejection channel 54, the ink in the common ink chamber 71 is induced into the ejection channel 54 through the slit 72. Then, the ink having been induced into the ejection channel 54 propagates inside the ejection channel 54 as a pressure wave. The drive voltage between the common electrode 61 and the individual electrode 63 is vanished at the timing at which the pressure wave has reached the nozzle 78. Thus, the shapes of the two drive walls 56 are restored, and the capacity of the ejection channel 54 having once increased is restored to the original capacity. Due to this operation, the internal pressure of the ejection channel 54 increases to pressurize the ink in the ejection channel 54. As a result, it is possible to eject the ink from the nozzle 78. On this occasion, the ink becomes an ink droplet having a droplet shape when passing through the nozzle 78, and is then ejected. Thus, it is possible to record characters, images, and the like on the recording paper P as described above.

It should be noted that the operation method of the inkjet head 4 is not limited to the content described above. For example, it is also possible to adopt a configuration in which the drive walls 56 in the normal state are deformed toward the inside of the ejection channel 54 as if the ejection channel 54 gives inward. This case can be realized by setting the drive voltage to be applied between the common electrode 61 and the individual electrode 63 to the voltage having an opposite polarity to that of the voltage described above, or by reversing the polarization direction of the actuator plate 51 without changing the polarity of the voltage. Further, it is also possible to deform the ejection channel 54 so as to bulge outward, and then deform the ejection channel 54 so as to give inward to thereby increase the pressurizing force of the ink when ejecting the ink.

(C. Functions/Advantages)

Then, the functions and the advantages in the head chips 40, the inkjet head 4, and the printer 1 according to the present embodiment will be described in detail.

In the head chips 40 according to the present embodiment, the actuator plate 51 is provided with the bypass electrodes 64B in addition to the individual electrode pads 64, and the bypass electrodes 64B are disposed at the positions closer to the channel forming region R2 than the individual electrode pads 64. Thus, it is possible to more surely maintain the connection of the pair of individual electrodes 63 adjacent to each other across the ejection channel 54. Hereinafter, the function and the advantages will be described.

The piezoelectric material such as PZT constituting the actuator plate 51 is relatively low in mechanical strength, and breakage, a crack, or the like easily occurs. An external impact is apt to act in particular on the vicinity of the upper end surface 512 and the lower end surface 511 of the actuator plate 51, and therefore, the breakage, the crack, or the like easily occurs. If the breakage, the crack, or the like occurs in the vicinity of the upper end surface 512 of the actuator plate 51 in the stages of fabrication, distribution, and so on of the head chips 40, the individual electrode pads 64 is broken, and thus, a conduction failure occurs. Specifically, the electrical connection between the pair of individual electrodes 63 adjacent to each other across the ejection channel 54 cannot be maintained, and the pair of individual electrodes 63 cannot be commonalized. Therefore, there is a possibility that the yield drops.

In contrast, in the head chips 40 (the actuator plate 51) according to the present embodiment, there are disposed the bypass electrodes 64B for electrically connecting the pair of individual electrodes 63 adjacent to each other across the ejection channel 54 to each other separately from the individual electrode pads 64. Further, the bypass electrodes 64B are disposed at the positions closer to the channel forming region R2 than the individual electrode pads 64. Therefore, even if the breakage, the crack, or the like occurs in the vicinity of the upper end surface 512 of the actuator plate 51, and thus, the individual electrode pads 64 are broken, the pair of individual electrodes 63 adjacent to each other across the ejection channel 54 are electrically connected to each other. Specifically, even in the case in which the breakage, the crack, or the like of the actuator plate 51 occurs, it is possible to commonalize the pair of individual electrodes 63 adjacent to each other across the ejection channel 54. Therefore, it is possible to suppress the drop of the yield of the head chips 40 due to the conduction failure.

Further, the bypass electrodes 64B are disposed inside the bypass groove G provided to the obverse surface 51/1. Thus, it is possible to prevent the short circuit between the bypass electrodes 64B and the wiring board 45 connected to the common electrode pads 62 from occurring. Hereinafter, the function and the advantages will be described.

For example, it is conceivable to dispose the bypass electrodes 64B on the reverse surface 51/2 side. In this case, the bypass electrodes 64B and the common electrode pads 62 are both disposed on the reverse surface 51/2 side of the actuator plate 51. To the common electrode pads 62, there is coupled the wiring board 45. Therefore, there is a possibility that when connecting the wiring board 45 to the common electrode pads 62, the wiring board 45 is deflected, and thus, the short circuit occurs between the wiring board 45 and the bypass electrode 64B. Therefore, there is a possibility that the reliability of the head chips 40 is damaged.

It is conceivable to provide a groove on the reverse surface 51/2 side to dispose the bypass electrodes 64B in the groove. However, in this case, since the bypass electrodes 64B are exposed on the reverse surface 51/2, the short circuit between the wiring board 45 and the bypass electrodes 64B can occur. Further, if the depth of the groove is small, it becomes easier for the short circuit to occur, and therefore, it becomes necessary to form a deep groove. Therefore, it becomes difficult to reduce the thickness (the size in the Y-axis direction) of the actuator plate 51.

In contrast, in the head chips 40 (the actuator plate 51) according to the present embodiment, since the bypass electrodes 64B are disposed at the positions not exposed on the reverse surface 51/2 provided with the common electrode pads 62, even when the wiring board 45 is deflected when connecting the wiring board 45 to the common electrode pads 62, it is possible to prevent the short circuit between the wiring board 45 and the bypass electrodes 64B from occurring. Therefore, it becomes possible to enhance the reliability of the head chips 40.

Here, such bypass electrodes 64B are disposed inside the bypass groove G provided to the obverse surface 51/1. It is also possible to dispose the bypass electrodes 64B on the obverse surface 51/1 without disposing the bypass groove G. Alternatively, it is also possible to dispose a tunnel-like hole extending in the X-axis direction between the reverse surface 51/2 and the obverse surface 51/1. However, by disposing the bypass electrodes 64B inside the bypass groove G, the bypass electrodes 64B are surrounded by the sidewalls of the bypass groove G, and are protected. Therefore, the broken line and so on of the bypass electrodes 64B due to, for example, a failure in the manufacturing process can be prevented from occurring. Further, the bypass groove G can easily be formed compared to the tunnel-like hole disposed between the reverse surface 51/2 and the obverse surface 51/1.

Further, it is sufficient for the bypass groove G to be capable of housing the bypass electrodes 64B, and therefore, the depth of the bypass groove G can be made smaller. Therefore, it is possible to reduce the thickness of the actuator plate 51 to reduce the size of the head chip 40.

Further, although the ejection channels 54 and the dummy channels 55 each have the openings on the surfaces 51/1, 51/2, the openings on the reverse surface 51/2 are closed by the sealing plate 53. In other words, it is arranged that the actuator plate 51 is supplied with the ink from the obverse surface 51/1 side. By providing the bypass groove G to the obverse surface 51/1 on the ink supply side, it becomes possible to form the bypass groove G in the same process as the formation process of the ejection channels 54 and the dummy channels 55 as described above. Therefore, it is possible to form the bypass groove G in a simplified process compared to the case (e.g., an inkjet head 4C shown in FIG. 15 described later) of disposing the bypass groove G on the opposite surface to the surface on the ink supply side.

Further, in the head chips 40 according to the present embodiment, the common electrode pads 62 electrically connected to the common electrodes 61 covering the inner surfaces of the ejection channels 54 are disposed on the reverse surface 51/2 on the opposite side to the cover plate 52 for supplying the ink to the ejection channels 54 out of the actuator plate 51. Therefore, the external device for supplying the voltage to the common electrodes 61 can easily be coupled to the common electrode pads 62. Further, in the head chips 40, the nozzle plate 44 is disposed so as to be opposed to the lower end surface 511 including the openings 54K through which the ink is ejected, and it is arranged that the actuator plate 51 and the cover plate 52 are stacked on one another in the thickness direction (the Y-axis direction) perpendicular to the extending direction (the Z-axis direction) of the ejection channels 54. Therefore, in the head chips 40, the connection to the external device becomes possible on the reverse surface 51/2 on the opposite side to the cover plate 52 out of the actuator plate 51. As a result, the paths of the common electrode pads 62 provided to the actuator plate 51 and to be coupled to the common electrodes 61 are simplified, and moreover, the path length of each of the common electrode pads 62 is shortened. Therefore, broken lines of the common electrode pads 62 are difficult to occur. Further, since the resistance value of the common electrode pad 62 can be reduced due to the reduction in path length of the common electrode pad 62, it is possible to reduce the heat generation amount when driving the head chips 40.

In the head chips 40, a plating method can be selected as the formation method of the common electrodes 61, and moreover, since the ejection channels 54 penetrate the actuator plate 51 in the Y-axis direction, it is also possible to select a two-sided evaporation process. Specifically, using the two-sided evaporation process of forming the metal coatings MF1 by the evaporation from the obverse surface 51/1 side as shown in FIG. 9C, and then forming the metal coatings MF2 by the evaporation from the reverse surface 51/2 side as shown in FIG. 9F, it is possible to form the common electrodes 61. Therefore, in the head chips 40, the degree of freedom of the formation method of the common electrodes 61 increases. In contrast, in the case in which the ejection channels do not penetrate the actuator plate in the thickness direction, naturally, the two-sided evaporation process cannot be applied. It should be noted that in the case in which the actuator plate 51 is the chevron type stacked substrate as shown in FIG. 6, it is desirable to form the common electrodes 61 using the two-sided evaporation process described above. However, in the case in which the actuator plate 51 is not the chevron type stacked substrate, it is desirable to form the common electrodes 61 by performing only the evaporation from one side, for example, by performing only the evaporation from the obverse surface 51/1 without performing the evaporation from the reverse surface 51/2 side.

Further, in the head chips 40, among the three parts, namely the actuator plate 51, the cover plate 52, and the sealing plate 53, the shape of the sealing plate 53 is simplified. Therefore, since the high processing accuracy becomes unnecessary when manufacturing the sealing plate 53, it is possible to form the sealing plate 53 using a material which is difficult to process with high accuracy. In other words, the degree of freedom of selection of the constituent material of the sealing plate 53 is increased.

Further, in the inkjet head 4 according to the present embodiment, since it is arranged that the common flow channel plate 41 is disposed between the two head chips 40A, 40B, a part of the ink flow channel can be used in common. However, in the inkjet head described in, for example, JP-A-2007-50687, it is arranged that ink chamber plates 7, 10 including an ink chamber are disposed on the outer side of piezoelectric ceramic plates 2, 5 including grooves through which the ink flows. In other words, the flow channel of the ink for supplying the ink to the piezoelectric ceramic plate 2 and the flow channel of the ink for supplying the ink to the piezoelectric ceramic plate 5 are separated from each other. Therefore, the dimension in the stacking direction of the piezoelectric ceramic plates 2, 5 and the ink chamber plates 7, 10, namely the thickness is apt to increase. Alternatively, as the inkjet head described in the specification of U.S. Pat. No. 8,091,987, since two systems of ink flow channels become necessary also in the structure in which the ink having ejected from the ejection ends of the pair of actuator plates arranged so as to be adjacent to each other is discharged outside the pair of actuator plates, the thickness is also apt to increase. In contrast, in the inkjet head 4 according to the present embodiment, since the flow channels for supplying the ink to the two head chips 40A, 40B can be consolidated, it is possible to realize the inkjet head 4 in which a simpler structure compared to the related art is realized, the thickness in the Y-axis direction is reduced, and the weight is reduced.

The head chips 40 according to the present embodiment is arranged to be further provided with the individual electrodes 63 disposed on the inner surfaces of the dummy channels 55, and the individual electrode pads 64 disposed on the reverse surface 51*f*2. Therefore, by applying the drive voltage between the common electrode 61 and the individual electrode 63, it is possible to cause the thickness-shear deformation in the two drive walls 56 for defining the ejection channel 54 to introduce the ink into the ejection channel 54, and by vanishing the drive voltage between the common electrode 61 and the individual electrode 63, it is possible to restore the drive walls 56 to eject the ink from the ejection channel 54. In particular, since the actuator plate 51 is formed of the chevron substrate having the structure in which the two piezoelectric substrates 51*a*, 51*b* on which the polarization treatment has been performed in the thickness direction are stacked on one another, it is possible to decrease the drive voltage of the actuator plate 51 compared to the case of using a monopole substrate as the actuator plate 51.

Further, in the head chips 40 according to the present embodiment, the lower end part of each of the ejection channels 54 forms the opening 54K exposed on the lower end surface 511 of the actuator plate 51, and the upper end part of each of the ejection channels 54 forms the closed end including the tilted surface 54*b* terminated within the actuator plate 51. Therefore, the ink supplied from the liquid supply channel 70 of the cover plate 52 to the ejection channel 54 is guided by the tilted surface 54*b* of the closed end so as to proceed toward the opening 54K. Therefore, since the ink can smoothly move inside the ejection channel 54, the stable ejection operation can be realized.

2. MODIFIED EXAMPLES

Then, some modified examples (Modified Examples 1 through 3) of the embodiment described above will be described. It should be noted that substantially the same constituents as those in the embodiment are denoted by the same reference symbols, and the description thereof will arbitrarily be omitted.

Modified Example 1

Figure 13:
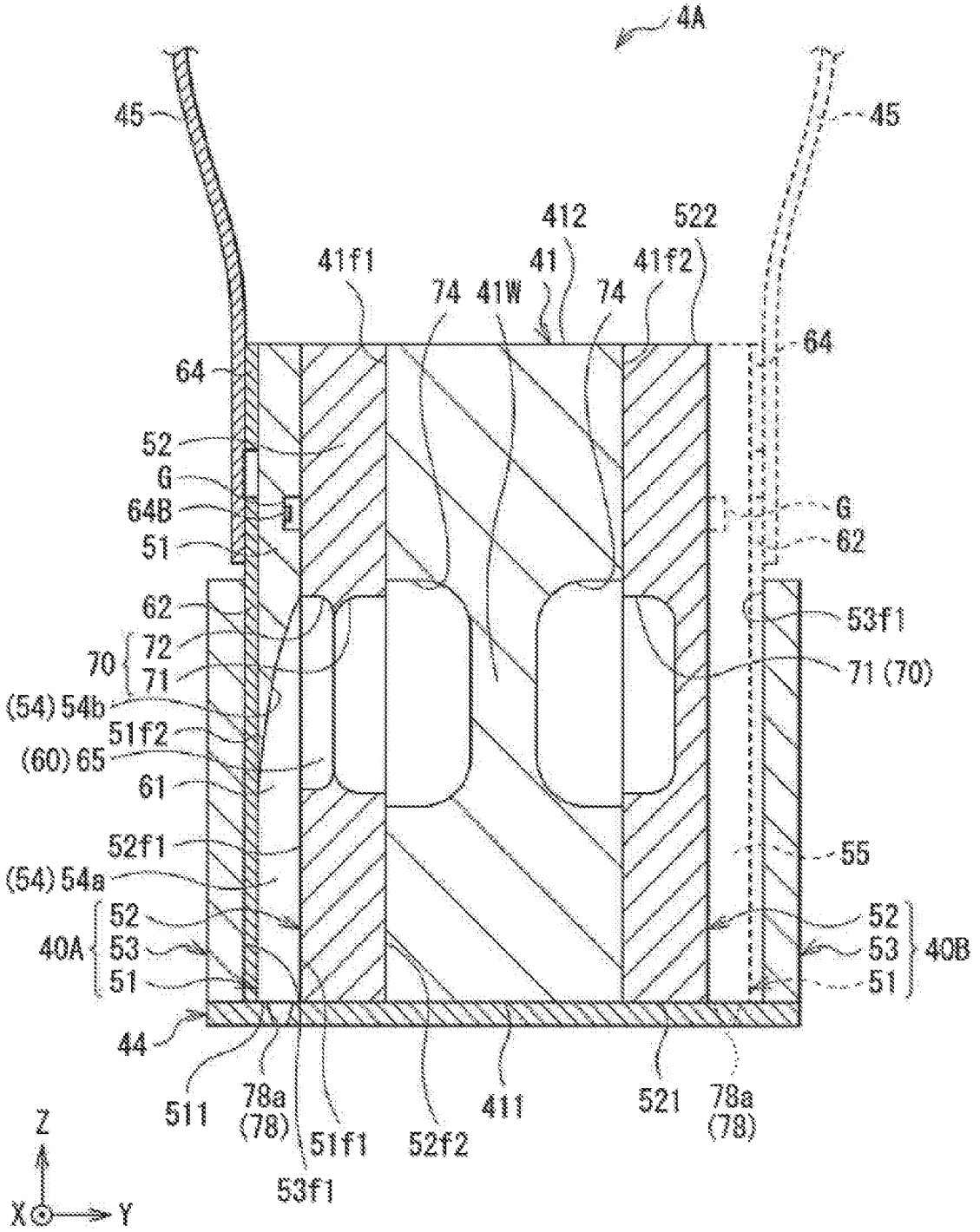
FIG. 13 is a cross-sectional view of a liquid jet head according to Modified Example 1.

FIG. 13 shows a cross-sectional surface along the extending direction of the ejection channels 54 in an inkjet head 4A according to Modified Example 1. FIG. 13 corresponds to FIG. 4 showing the inkjet head 4 according to the embodiment described above. The inkjet head 4 according to the embodiment described above has the structure in which the return plate 43 is inserted between the head chips 40 and the nozzle plate 44 to perform the ink circulation between the ink tank 3 and the inkjet head 4. In contrast, the inkjet head 4A according to Modified Example 1 shown in FIG. 13 does not have the return plate 43. Specifically, the nozzle plate 44 is bonded to the lower end surfaces 511, 521, and 531 of the head chips 40A, 40B and the lower end surface 411 of the flow channel plate 41 with an adhesive or the like. Further, the flow channel plate 41 is provided with the entrance flow channels 74, but is not provided with the exit flow channels 75. Therefore, in the inkjet head 4A, it is arranged that the ink circulation in the inside is not performed, and the ink to be ejected from the opening 54K of the ejection channel 54 proceeds toward the nozzle plate 44, and is then ejected from the nozzle 78. The inkjet head 4A according to Modified Example 1 has substantially the same configuration as that of the inkjet head 4 according to the embodiment described above in other points except the point described above, and can therefore be provided with substantially the same advantages as in the inkjet head 4 according to the embodiment described above.

Modified Example 2

Figure 14:
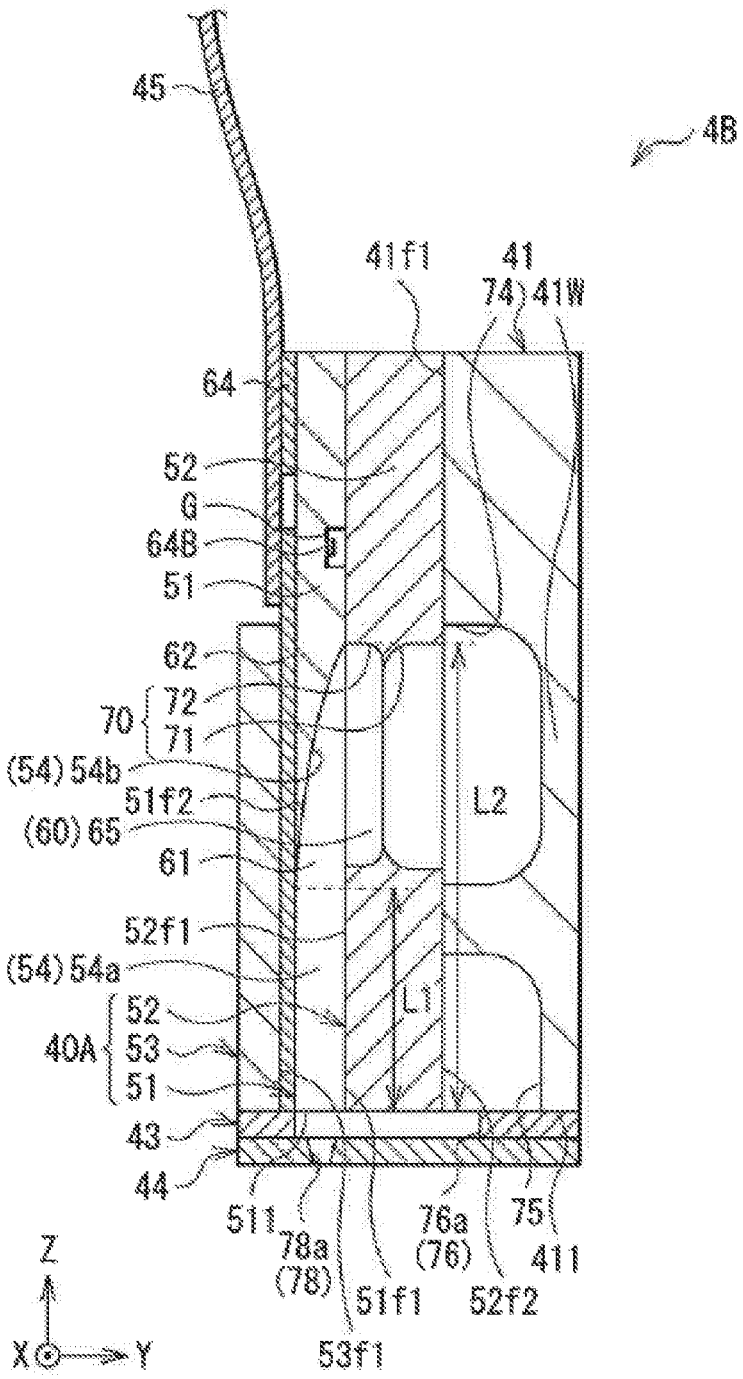
FIG. 14 is a cross-sectional view of a liquid jet head according to Modified Example 2.

FIG. 14 shows a cross-sectional surface along the extending direction of the ejection channels 54 in an inkjet head 4B according to Modified Example 2. FIG. 14 corresponds to FIG. 4 showing the inkjet head 4 according to the embodiment described above. The inkjet head 4 according to the embodiment described above has the structure in which the head chip 40A and the head chip 40B are disposed on both sides of one flow channel plate 41. In contrast, the inkjet head 4B according to Modified Example 2 shown in FIG. 14 has a structure in which the head chip 40 is disposed only on one side of one flow channel plate 41B. The inkjet head 4B according to Modified Example 2 has substantially the same configuration as that of the inkjet head 4 according to the embodiment described above in other points than the point described above.

Modified Example 3

Figure 15:
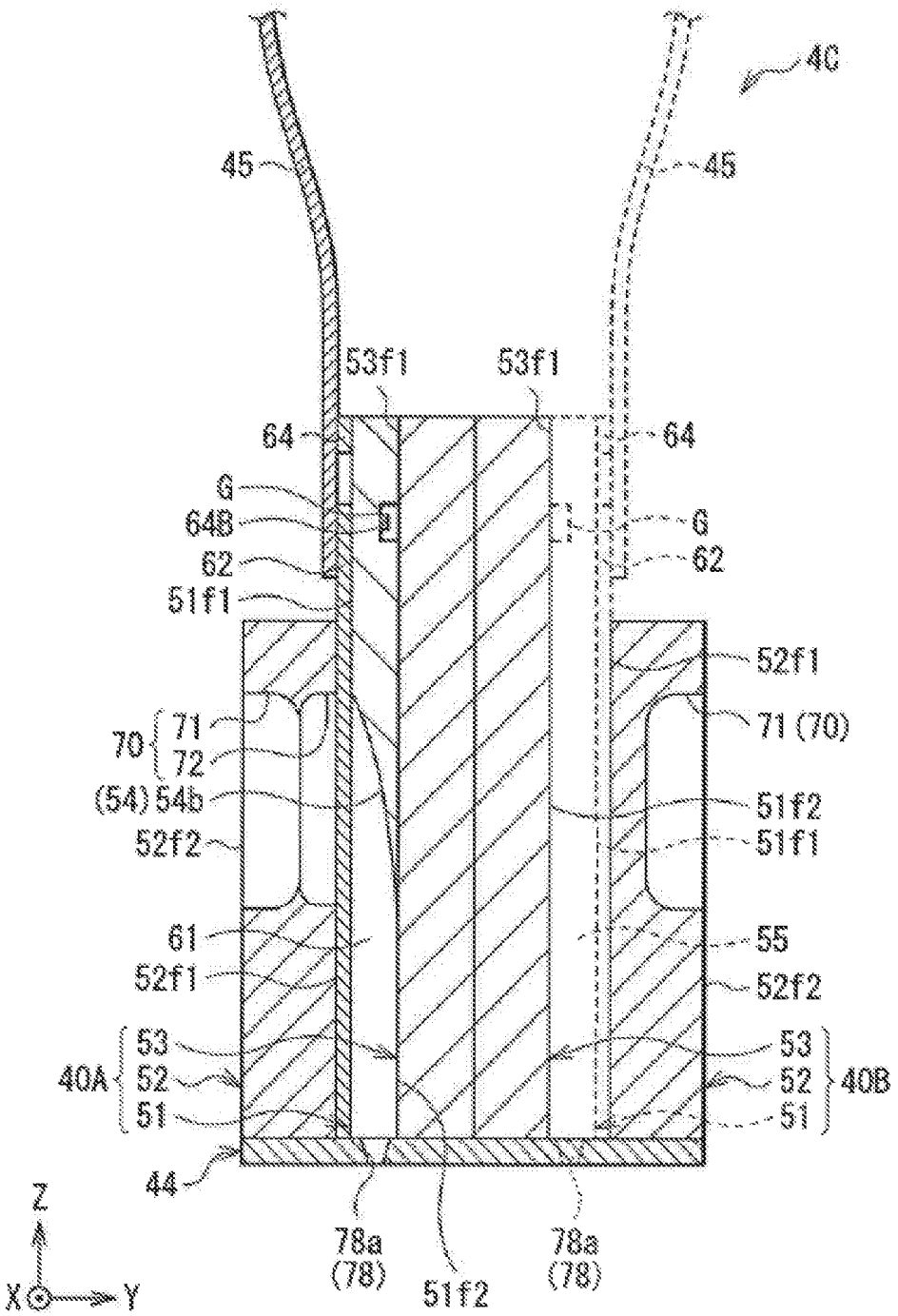
FIG. 15 is a cross-sectional view of a liquid jet head according to Modified Example 3.

FIG. 15 shows a cross-sectional surface along the extending direction of the ejection channels 54 in an inkjet head 4C according to Modified Example 3. FIG. 15 corresponds to FIG. 4 showing the inkjet head 4 according to the embodiment described above. The inkjet head 4 according to the embodiment described above has the structure in which the common electrode pads 62 and the individual electrode pads 64 are disposed on the reverse surface 51*f*2 of the actuator plate 51. In contrast, the inkjet head 4C according to Modified Example 3 shown in FIG. 15 has a structure in which the common electrode pads 62 and the individual electrode pads 64 are disposed on the obverse surface 51*f*1 of the actuator plate 51. The inkjet head 4C according to Modified Example 3 has substantially the same configuration as that of the inkjet head 4 according to the embodiment described above in other points than the point described above.

The pair of head chips 40A, 40B are disposed so that the sealing plates 53 of the pair of head chips 40A, 40B are adjacent to each other in the Y-axis direction, and the cover plate 52 of the head chip 40A and the cover plate 52 of the head chip 40B are opposed to each other across the sealing plates 53 and the actuator plates 51 of the pair of head chips 40A, 40B.

In the inkjet head 4C, the common electrode pads 62 and the individual electrode pads 64 are disposed on the obverse surface 51*f*1 to be the ink supply side of the actuator plate 51, and the bypass groove G and the bypass electrodes 64B are disposed on the reverse surface 51*f*2 with the sealing plate 53. Here, the "obverse surface 51*f*1" is a specific example corresponding to the "first surface" of the present disclosure, and the "reverse surface 51*f*2" is a specific example corresponding to the "second surface" of the present disclosure. In the inkjet head 4C, for example, it is sufficient to form the reverse surface 51*f*2 of the actuator plate 51 (the process shown in FIG. 9E), and then form the bypass groove G and the bypass electrodes 64B.

It is not required for the inkjet head 4C to have the return plate 43 similarly to the case described in the inkjet head 4A according to Modified Example 1 described above. It is also possible for the inkjet head 4C to have a single head chip 40 similarly to the case described in the inkjet head 4B according to Modified Example 2 described above.

3. OTHER MODIFIED EXAMPLES

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head, and the head chip, but those described in the above embodiment and so on are not limitations, and it is possible to adopt other shapes, arrangements, numbers and so on.

In the embodiment and so on described above, the description is presented illustrating the so-called edge-shoot type inkjet head for ejecting the ink from the ejection end (the opening 54K) as an end part in the extending direction of the ejection channels, but the liquid jet head according to the present disclosure is not limited to the illustration. Specifically, it is also possible to adopt a so-called side-shoot type inkjet head in which the ink passes in the thickness direction of the actuator plate, namely the depth direction of the ejection channels.

Further, the method of forming the liquid jet head chip according to the present disclosure is not limited to the procedure explained in the embodiment described above. For example, after the processes shown in FIG. 9A through FIG. 9E, it is also possible to form the metal coatings MF2 and the metal coatings MF3 in a lump as described below. Specifically, as shown in FIG. 9E, the grinding work is performed on the piezoelectric wafer 51*b*Z from the reverse surface to expose the plurality of ejection channels 54 and the plurality of dummy channels 55. Then, unlike the resist pattern RP2 shown in FIG. 9G, the resist pattern is selectively formed on the reverse surface 51*f*2 so as not to close the plurality of dummy channels 55. Specifically, the resist pattern is selectively formed on the reverse surface 51*f*2 of the parts where the ejection channels 54 or the dummy channels 55 are not formed out of the piezoelectric substrate 51*b*, namely the parts eventually turn to the drive walls 56, in the piezoelectric substrate 51*b*. Subsequently, the metal coatings MF2 covering the inner surfaces 541 of the plurality of the ejection channels 54 and the inner surfaces 551 of the plurality of dummy channels 55, and the metal coatings MF3 covering the reverse surface 51*f*2 and the resist pattern using, for example, an evaporation method in a lump. Subsequently, the resist pattern is removed. As a result, there remain only the parts covering the inner surfaces 541 of the ejection channels 54 or the inner surfaces 551 of the dummy channels 55 out of the metal coatings MF2, and thus, the common electrodes 61 and the individual electrodes 63 are formed. In addition, some parts of the metal coatings MF3 remain in the reverse surface 51*f*2 to form the common electrode pads 62 and the individual electrode pads 64.

Further, although in the embodiment and so on described above, there is described the example in which the ejection channels and the dummy channels each have the openings on the two opposed surfaces (the surfaces 51*f*1, 51*f*2) of the actuator plate, it is also possible for each of the ejection channels and the dummy channels to have the opening on either one of the opposed surfaces of the actuator plate.

Further, in the embodiment and so on described above, there is illustrated the chevron type actuator plate in which the two piezoelectric substrates having the respective polarization directions different from each other are stacked on one another, but it is also possible for the inkjet head according to the present disclosure to be an inkjet head having a so-called cantilever type (monopole type) actuator plate. The cantilever type actuator plate is formed of a single piezoelectric substrate having the polarization direction set to one direction along the thickness direction. It should be noted that in the cantilever type actuator plate, for example, the drive electrode is attached to the upper half in the depth direction with the oblique vapor deposition. Therefore, by the drive force acting only on the part provided with the drive electrode, the drive walls make the flexural deformation. As a result, even in this case, since the drive walls make the flexural deformation to have the V-shape, it results in that the ejection channel deforms as if the ejection channel bulges.

Further, in the embodiment and so on described above, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "head chip" (the head chips 40A, 40B) and the "liquid jet head" (the inkjet head 4) of the present disclosure are applied to other devices than the inkjet printer. Specifically, it is also possible to arrange that the "head chip" and the "liquid jet head" of the present disclosure are applied to a device such as a facsimile or an on-demand printer.

It should be noted that the advantages described in the specification are illustrative only but are not a limitation, and other advantages can also be provided.

Further, the present disclosure can also take the following configurations.

<1>

A liquid jet head adapted to jet liquid, comprising an actuator plate adapted to apply pressure to the liquid; and a wiring board, wherein the actuator plate includes a first surface, and a second surface facing to an opposite side to the first surface, ejection channels and non-ejection channels which have an opening on at least one of the first surface and the second surface and are alternately arranged so as to be separated from each other, a common electrode disposed on a sidewall of the ejection channel, an individual electrode electrically separated from the common electrode and disposed on a sidewall of the non-ejection channel, a common electrode pad disposed on the first surface and adapted to electrically connect the common electrode and the wiring board to each other, and a bypass interconnection adapted to electrically connect the individual electrodes in the non-ejection channels adjacent to each other and failing to be exposed on the first surface.

<2>

The liquid jet head according to <1>, wherein the bypass interconnection is disposed on the second surface.

<3>

The liquid jet head according to <1> or <2>, wherein a bypass groove extending in a direction in which the ejection channels and the non-ejection channels are arranged is provided to the second surface, and the bypass interconnection is disposed in the bypass groove.

<4>

The liquid jet head according to any one of <1> to <3>, wherein the actuator plate further includes an individual electrode pad which electrically connects the individual electrodes in the non-ejection channels adjacent to each other and which is provided to the first surface.

<5>

The liquid jet head according to any one of <1> to <4>, further comprising a sealing plate opposed to the actuator plate; and a cover plate which includes a liquid flow hole communicated with the ejection channel, and which is disposed so as to be opposed to the sealing plate across the actuator plate, wherein the ejection channels and the non-ejection channels have the opening on both of the first surface and the second surface, and the sealing plate closes the opening on the first surface of the ejection channels and the non-ejection channels.

<6>

The liquid jet head according to <5>, further comprising a return plate which is disposed in a direction crossing the actuator plate, and has a circulation channel communicated with the ejection channels; a first actuator plate and a second actuator plate respectively corresponding to the actuator plate; a first cover plate and a second cover plate respectively corresponding to the cover plate; a first sealing plate and a second sealing plate respectively corresponding to the sealing plate; and a flow channel plate disposed between the first sealing plate and the second sealing plate, wherein the first actuator plate is disposed between the first sealing plate and the flow channel plate, the second actuator plate is disposed between the second sealing plate and the flow channel plate, the first cover plate is disposed between the first actuator plate and the flow channel plate, the second cover plate is disposed between the second actuator plate and the flow channel plate, and the flow channel plate includes a liquid supply flow channel communicated with the liquid flow hole of the first cover plate and the liquid flow hole of the second cover plate, and a liquid discharge flow channel communicated with the circulation channel.

<7>

A liquid jet recording device comprising the liquid jet head according to any one of <1> to <6>; and a containing section adapted to contain the liquid.

<8>

A head chip adapted to jet liquid, comprising an actuator plate adapted to apply pressure to the liquid, wherein the actuator plate includes a first surface, and a second surface facing to an opposite side to the first surface; ejection channels and non-ejection channels which have an opening on at least one of the first surface and the second surface and are alternately arranged so as to be separated from each other; a common electrode disposed on a sidewall of the ejection channel; an individual electrode electrically separated from the common electrode and disposed on a sidewall of the non-ejection channel; a common electrode pad disposed on the first surface and adapted to electrically connect the common electrode and an external interconnection to each other; and a bypass interconnection adapted to electrically connect the individual electrodes in the non-ejection channels adjacent to each other and failing to be exposed on the first surface.

What is claimed is:

1. A liquid jet head adapted to jet liquid, comprising:

an actuator plate adapted to apply pressure to the liquid; and a wiring board, wherein the actuator plate includes:

a first surface, and a second surface facing to an opposite side to the first surface, ejection channels and non-ejection channels which have an opening on at least one of the first surface and the second surface and are alternately arranged so as to be separated from each other, a common electrode disposed on a sidewall of the ejection channel, an individual electrode electrically separated from the common electrode and disposed on a sidewall of the non-ejection channel, a common electrode pad disposed on the first surface and adapted to electrically connect the common electrode and the wiring board to each other, and a bypass interconnection adapted to electrically connect the individual electrodes in the non-ejection channels adjacent to each other and failing to be exposed on the first surface.

2. The liquid jet head according to claim 1, wherein the bypass interconnection is disposed on the second surface.

3. The liquid jet head according to claim 1, wherein a bypass groove extending in a direction in which the ejection channels and the non-ejection channels are arranged is provided to the second surface, and the bypass interconnection is disposed in the bypass groove.

4. The liquid jet head according to claim 1, wherein the actuator plate further includes an individual electrode pad which electrically connects the individual electrodes in the non-ejection channels adjacent to each other and which is provided to the first surface.

5. The liquid jet head according to claim 1, further comprising:

a sealing plate opposed to the actuator plate; and a cover plate which includes a liquid flow hole communicated with the ejection channel, and which is disposed so as to be opposed to the sealing plate across the actuator plate, wherein the ejection channels and the non-ejection channels have the opening on both of the first surface and the second surface, and the sealing plate closes the opening on the first surface of the ejection channels and the non-ejection channels.

6. The liquid jet head according to claim 5, further comprising:

a return plate which is disposed in a direction crossing the actuator plate, and has a circulation channel communicated with the ejection channels;

a first actuator plate and a second actuator plate respectively corresponding to the actuator plate;

a first cover plate and a second cover plate respectively corresponding to the cover plate;

a first sealing plate and a second sealing plate respectively corresponding to the sealing plate; and a flow channel plate disposed between the first sealing plate and the second sealing plate, wherein the first actuator plate is disposed between the first sealing plate and the flow channel plate, the second actuator plate is disposed between the second sealing plate and the flow channel plate, the first cover plate is disposed between the first actuator plate and the flow channel plate, the second cover plate is disposed between the second actuator plate and the flow channel plate, and the flow channel plate includes a liquid supply flow channel communicated with the liquid flow hole of the first cover plate and the liquid flow hole of the second cover plate, and a liquid discharge flow channel communicated with the circulation channel.

7. A liquid jet recording device comprising:

the liquid jet head according to claim 1; and a containing section adapted to contain the liquid.

8. A head chip adapted to jet liquid, comprising an actuator plate adapted to apply pressure to the liquid, wherein the actuator plate includes:

a first surface, and a second surface facing to an opposite side to the first surface;

ejection channels and non-ejection channels which have an opening on at least one of the first surface and the second surface and are alternately arranged so as to be separated from each other;

a common electrode disposed on a sidewall of the ejection channel;

an individual electrode electrically separated from the common electrode and disposed on a sidewall of the non-ejection channel;

a common electrode pad disposed on the first surface and adapted to electrically connect the common electrode and an external interconnection to each other; and a bypass interconnection adapted to electrically connect the individual electrodes in the non-ejection channels adjacent to each other and failing to be exposed on the first surface.

* * * * *